US012442293B2

(12) United States Patent
Bhome et al.

(10) Patent No.: US 12,442,293 B2
(45) Date of Patent: Oct. 14, 2025

(54) CORING TOOLS HAVING CORING SHAFTS WITH ASSOCIATED INTERNAL STATIC SLEEVES

(71) Applicant: Schlumberger Technology Corporation, Sugar Land, TX (US)

(72) Inventors: Amol Bhome, Richmond, TX (US); Mark Milkovisch, Cypress, TX (US); Daniel G. De La Garza, Alvin, TX (US); Joseph Matthew Casassa, Needville, TX (US); Lijun Song, Sugar Land, TX (US); Is Haq Mohsin Shaikh, Pune (IN); Swapnil Barathe, Pune (IN); Christopher Leake, Sugar Land, TX (US); Charles Haddad, Kristiansand (NO); Viraj Singh, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/720,504

(22) PCT Filed: Jan. 25, 2023

(86) PCT No.: PCT/US2023/011535
§ 371 (c)(1),
(2) Date: Jun. 14, 2024

(87) PCT Pub. No.: WO2023/146910
PCT Pub. Date: Aug. 3, 2023

(65) Prior Publication Data

US 2025/0067174 A1 Feb. 27, 2025

Related U.S. Application Data

(60) Provisional application No. 63/302,821, filed on Jan. 25, 2022.

(51) Int. Cl.
*E21B 49/06* (2006.01)

(52) U.S. Cl.
CPC ..... *E21B 49/06* (2013.01)

(58) Field of Classification Search
CPC ..... E21B 49/06
See application file for complete search history.

(56) References Cited

U.S. PATENT DOCUMENTS 2,176,375 A 10/1939 Mcclinton
2,181,980 A 12/1939 Seale
(Continued)

FOREIGN PATENT DOCUMENTS

CN 114198026 A 3/2022
WO WO-2021237092 A1 * 11/2021 ..... E21B 10/02

OTHER PUBLICATIONS

Search Report and Written Opinion of International Patent Application No. PCT/US2023/011535 dated May 18, 2023, 8 pages.
(Continued)

*Primary Examiner* — Jennifer H Gay
(74) *Attorney, Agent, or Firm* — Jeffrey D. Frantz

(57) ABSTRACT

The systems and methods presented herein include a sidewall coring tool assembly that includes a coring shaft having an internal cavity and configured to be coupled to a coring motor shaft of a coring motor at a first axial end of the coring shaft. The coring shaft includes a plurality of scoops disposed circumferentially on a first external surface of the coring shaft. Each scoop of the plurality of scoops forms a conduit from an exterior of the coring shaft to an interior of the coring shaft. The sidewall coring tool assembly also includes a coring bit coupled to the coring shaft at a second axial end of the coring shaft. The sidewall coring tool
(Continued)

assembly further includes a static sleeve coupled to the coring motor and disposed radially within the internal cavity of the coring shaft.

14 Claims, 16 Drawing Sheets

(56) References Cited

U.S. PATENT DOCUMENTS

| | | | | |
|---|---|---|---|---|
| 7,431,107 | B2 * | 10/2008 | Hill | E21B 49/06 175/246 |
| 8,210,284 | B2 * | 7/2012 | Buchanan | E21B 25/16 166/100 |
| 8,613,330 | B2 * | 12/2013 | Moon | E21B 4/02 175/239 |
| 8,919,460 | B2 * | 12/2014 | Joulin | E21B 4/02 175/58 |
| 9,097,102 | B2 * | 8/2015 | Ward | E21B 10/02 |
| 9,689,256 | B2 * | 6/2017 | Tevis | E21B 49/06 |
| 10,301,937 | B2 | 5/2019 | Buchanan | |
| 12,037,900 | B2 * | 7/2024 | Bhome | E21B 10/44 |
| 2002/0148643 | A1 | 10/2002 | Contreras | |
| 2004/0065478 | A1 | 4/2004 | Gregory | |
| 2004/0140126 | A1 * | 7/2004 | Hill | E21B 49/06 175/58 |
| 2005/0133258 | A1 * | 6/2005 | Veneruso | E21B 49/06 175/58 |
| 2006/0054358 | A1 * | 3/2006 | Hill | E21B 49/06 175/58 |
| 2006/0076162 | A1 | 4/2006 | Tchakarov | |
| 2008/0078582 | A1 | 4/2008 | Phan | |
| 2011/0094801 | A1 * | 4/2011 | Buchanan | E21B 4/04 175/249 |
| 2011/0174543 | A1 | 7/2011 | Walkingshaw | |
| 2012/0000711 | A1 * | 1/2012 | Buchanan | E21B 25/16 175/249 |
| 2013/0008719 | A1 * | 1/2013 | Moon | E21B 49/02 175/58 |
| 2013/0068531 | A1 * | 3/2013 | Joulin | E21B 4/02 175/78 |
| 2013/0081879 | A1 * | 4/2013 | Ward | E21B 10/02 175/94 |
| 2014/0102794 | A1 * | 4/2014 | Tevis | E21B 47/024 33/304 |
| 2014/0131033 | A1 | 5/2014 | Galvan-Sanchez | |
| 2014/0291034 | A1 * | 10/2014 | Buchanan | E21B 25/16 175/404 |
| 2014/0311805 | A1 * | 10/2014 | Mageren | E21B 25/00 175/58 |
| 2017/0002654 | A1 * | 1/2017 | Buchanan | E21B 49/06 |
| 2021/0278563 | A1 | 9/2021 | Almarzooq | |
| 2023/0021299 | A9 | 1/2023 | Lachner | |
| 2023/0212944 | A1 * | 7/2023 | Bhome | E21B 10/605 175/77 |
| 2024/0287900 | A1 * | 8/2024 | Bhome | E21B 10/605 |
| 2025/0067174 | A1 * | 2/2025 | Bhome | E21B 10/02 |

OTHER PUBLICATIONS

International Preliminary Report on Patentability of International Patent Application No. PCT/US2023/011535 dated Aug. 8, 2024, 7 pages.

* cited by examiner

CORING TOOLS HAVING CORING SHAFTS WITH ASSOCIATED INTERNAL STATIC SLEEVES

CROSS-REFERENCE TO RELATED APPLICATION

This application is a National Stage Entry of International Application No. PCT/US2023/011535, filed Jan. 25, 2023, which claims priority to and the benefit of U.S. Provisional Patent Application Ser. No. 63/302,821, entitled "Turboshaft with Static Sleeve," filed Jan. 25, 2022, which is hereby incorporated by reference in its entirety for all purposes.

BACKGROUND

The present disclosure generally relates to systems and methods for performing sidewall coring within a wellbore using sidewall coring tools having coring shafts with associated internal static sleeves.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, and/or extraction of resources. These resources may include oil, gas, water, or any other combination of elements within the ground.

Wellbores or boreholes may be drilled to, for example, locate and produce hydrocarbons. During a well development operation, it may be desirable to evaluate and/or measure properties of encountered formations, formation fluids and/or formation gasses. Some formation evaluations may include extracting a core sample (e.g., a rock sample) from the sidewall of a wellbore. Core samples may be extracted using a coring tool coupled to a downhole tool that is lowered into the wellbore and positioned adjacent a formation. A hollow coring shaft or bit of the coring tool may be extended from the downhole tool and urged against the formation to penetrate the formation. A formation or core sample fills the hollow portion or cavity of the coring shaft and the coring shaft is removed from the formation retaining the sample within the cavity.

The sample obtained using the hollow coring bit is generally referred to as a "core sample" or "core plug." Once the core sample has been transported to the surface, it may be analyzed to assess, among other things, the reservoir storage capacity (e.g., porosity) and the flow potential (e.g., permeability) of the material that makes up the formation; the chemical and mineral composition of the fluids and mineral deposits contained in the pores of the formation; and the irreducible water content of the formation material. The information obtained from analysis of a sample is used to design and implement well completion and production facilities.

There are some formations that are very fragile, friable, or un-consolidated. Therefore, cores extracted from those formations are also fragile or friable. Recovering such cores has been a challenge for mechanical sidewall coring tools in general. Oftentimes when faced with friable formation, known tools are tried, the low (or zero) core recovery is accepted, or resort to trying percussion (explosive charges) coring. In any case, the cores needed are not obtained. The cores are susceptible to damage during different steps of coring action-namely core cutting, core breaking, core extraction, core deposition (into core catcher tube), and travel up from downhole to the surface. During core cutting step the core could get damaged due to unevacuated debris and/or rotational motion of the Core Catcher Ring (CCR).

The cuttings that are not removed from the outer diameter (OD) of the coring bit and coring shaft affect the efficient removal of cuttings. The cuttings not removed from the coring shaft's inner diameter (ID), the coring shaft's OD, around the CCR, and around the coring bit could slow down removal of freshly generated cuttings, thereby increasing the core cutting time. Also, the cuttings not removed from the ID of the coring bit and the ID of the coring shaft could wear down the core OD due to rubbing action.

By design, the CCR is free to rotate inside CCR grooves inside the coring bit. When working as designed, the CCR latches on a freshly cut core, slides axially on the core outside the core OD, but does not rotate with the coring bit. If and when unevacuated debris gets accumulated around the CCR, then the CCR starts rotating with the coring bit, thereby causing grinding action on the core OD.

SUMMARY

A summary of certain embodiments described herein is set forth below. It should be understood that these aspects are presented merely to provide the reader with a brief summary of these certain embodiments and that these aspects are not intended to limit the scope of this disclosure.

The systems and methods presented herein include a sidewall coring tool assembly that includes a coring shaft having an internal cavity and configured to be coupled to a coring motor shaft of a coring motor at a first axial end of the coring shaft. The coring shaft includes a plurality of scoops disposed circumferentially on a first external surface of the coring shaft. Each scoop of the plurality of scoops forms a conduit from an exterior of the coring shaft to an interior of the coring shaft. The sidewall coring tool assembly also includes a coring bit coupled to the coring shaft at a second axial end of the coring shaft. The sidewall coring tool assembly further includes a static sleeve coupled to the coring motor and disposed radially within the internal cavity of the coring shaft.

The systems and methods presented herein also include a sidewall coring tool assembly that includes a coring shaft having an internal cavity and configured to be coupled to a coring motor shaft of a coring motor at a first axial end of the coring shaft. The coring shaft includes a plurality of scoops disposed circumferentially on a first external surface of the coring shaft. Each scoop of the plurality of scoops forms a conduit from an exterior of the coring shaft to an interior of the coring shaft. The sidewall coring tool assembly also includes a coring bit coupled to the coring shaft at a second axial end of the coring shaft. The sidewall coring tool assembly further includes a static sleeve coupled to the coring motor and disposed radially within the internal cavity of the coring shaft. The sidewall coring tool assembly also includes a coring bit coupled to the coring shaft at a second axial end of the coring shaft. The sidewall coring tool assembly further includes a plurality of fins disposed on at least one of a second external surface of the coring bit and the first external surface of the coring shaft. In addition, the sidewall coring tool assembly includes a static sleeve coupled to the coring motor and disposed radially within the internal cavity of the coring shaft.

The systems and methods presented herein further include a sidewall coring tool assembly that includes a coring shaft having an internal cavity and configured to be coupled to a coring motor shaft of a coring motor at a first axial end of the coring shaft. The sidewall coring tool assembly also includes a coring bit coupled to the coring shaft at a second axial end of the coring shaft. The coring bit includes at least two cutting pads configured to create at least two outer passage areas circumferentially between the at least two cutting pads and radially exterior to the coring bit and at least two inner passage areas circumferentially between the at least two cutting pads and radially interior to the coring bit. The sidewall coring tool assembly further includes a static sleeve coupled to the coring motor and disposed radially within the internal cavity of the coring shaft.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
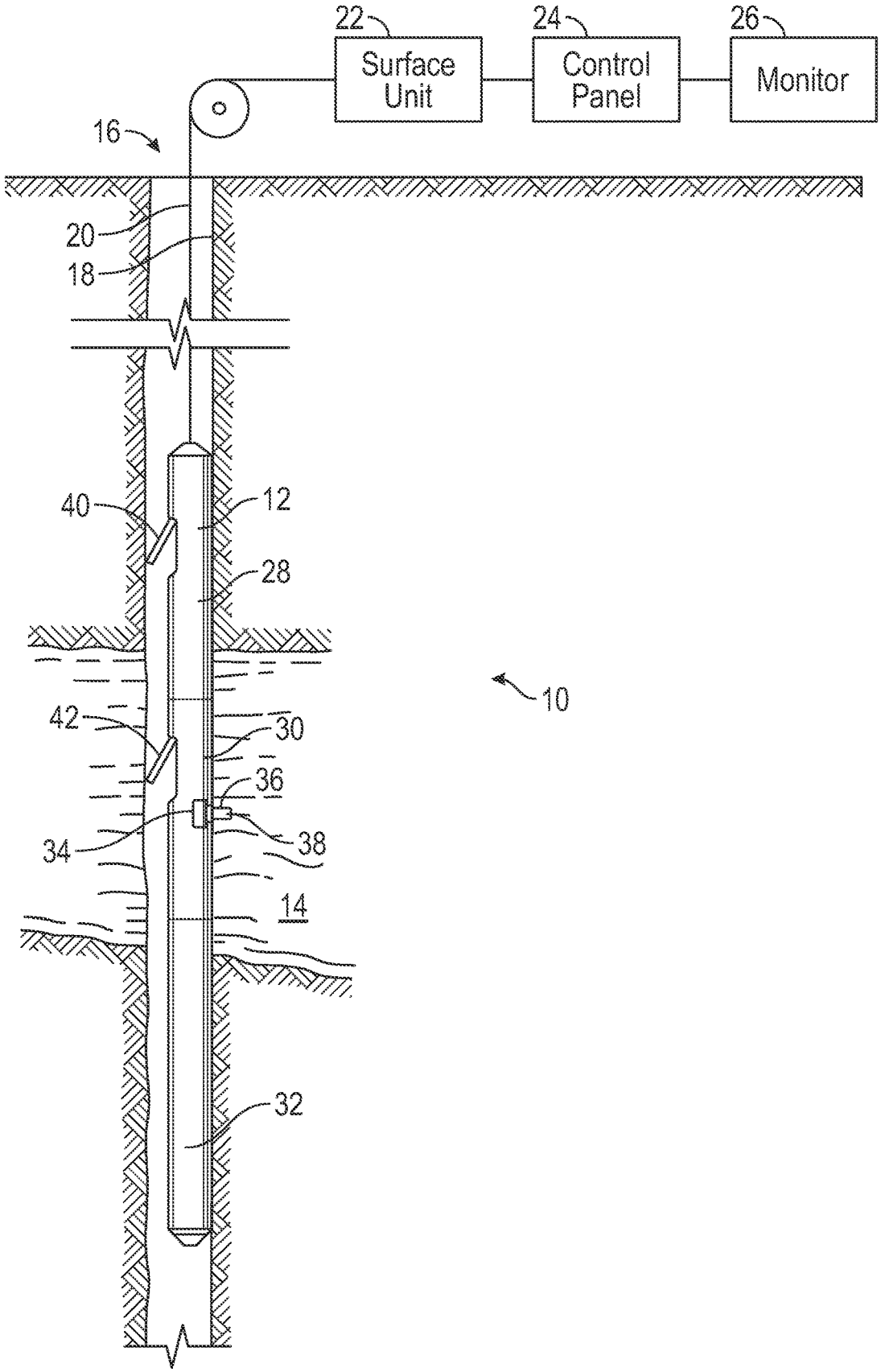
FIG. 1 is a schematic view of an embodiment of a coring system, according to one or more embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements; in other words, these terms are used in an open-ended fashion, and thus should be interpreted to mean "including, but not limited to . . . " Additionally, it should be understood that references to "one embodiment" or "an embodiment" of the present disclosure are not intended to be interpreted as excluding the existence of additional embodiments that also incorporate the recited features. Furthermore, the phrase "A based on B" is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, "defined flow" or "directed flow" or "active flow" generally refer to the purposeful movement of a fluid (e.g., mud) created by introduction of certain design features (e.g., the scoops, internal grooves, fins, and so forth, described herein) that function, for example, to draw mud in a borehole from one axial end of a coring shaft into an interior space of the coring shaft and to urge the mud to move axially towards a coring bit associated with the coring shaft. As the mud flows over and around the coring bit, it carries cuttings and heat with it. Then, as the mud moves along an outer diameter of the coring bit and the coring shaft, it may be further assisted or guided using external fins, as described in greater detail herein.

As described above, mechanical sidewall coring tools use a coring bit to cut into an annular space in the wellbore to create a cylindrical core sample or plug that can be extracted to the surface. A plurality of core samples or plugs can be cut and stored (usually sequentially) and returned to the surface for analysis. In general, the core plug is created by rotating and applying weight on an annular coring bit with cutting elements on the crown. This activity breaks the rock and cuttings are created. The rock cutting process at the rock bit interface generates heat. This heat, if not removed, has been shown to cause cutter degradation, relatively poor cutting performance, and reduction in cutter life. In addition, discoloration of the bit body has been observed in lab tests and in downhole coring operations, indicating poor heat removal and heat build-up. In some lab experiments, it has been observed that such heat build-up may de-hydrate the mud and burn the rock at the cutting face. Under certain conditions, this may result in bit stalling. In certain embodiments, a flow of fluid (usually drilling mud) is used to cool the tooling and move cuttings away from the bit face to make the cutting operation more efficient.

Typical mechanical sidewall coring tools cannot produce an active flow to the bit face. As such, the coring operation is conducted in a static mud environment using the rotation of the coring shaft and coring bit to encourage passive flow of the fluids and debris. In most cases, the wellbore pressure is higher than the formation pressure. When the coring bit exposes new rock, the wellbore fluids tend to move toward the fresh rock resulting in mud solids building up to form a seal known as mudcake. In addition, as new rock is exposed, fluids and solids also tend to move into the pores of the newly exposed rock and combined with the mudcake can make it difficult to move debris away from the bit face.

In addition, the lack of fluid flow to flush cuttings combined with a relatively small cross-sectional area for the movement of cuttings away from the bit face can result in bit stalling and jamming. For the cuttings that do move away from the bit face and into the space around the bit shaft, the lack of volume can cause cuttings to accumulate, resulting in drag on the bit, which reduces the torque passes to the bit face and increases the chance of jamming. As such, there is a need to provide a coring bit that allows the cuttings to pass through and move away from the bit face. The embodiments described herein reduce parasitic torque from the cuttings buildup at the bit face as well on the bit shaft outer and inner diameter.

In addition, sidewall coring tools typically have a mechanical prime mover (e.g., a hydraulic coring motor) to generate rotary power. This rotary power is transferred to the coring bit or rock cutting bit through the coring shaft of the sidewall coring tool. The coring bit drills into the formation with cutting elements made of a relatively hard material like diamonds. At the end of its stroke, the coring bit breaks the core sample off from the formation. The core sample can be temporarily stored inside the bit and shaft assembly before it is deposited into a core storage tube. In certain embodiments, a hydraulic circuit may activate and deactivate hydraulic pistons to manipulate the combined assembly of coring motor, coring shaft, and the coring bit to cut, break, retrieve, and store the core sample or plug.

The embodiments described herein relate to sidewall coring tools having coring bits and coring shafts that may be used to collect samples (e.g., rock samples, tar sand samples, etc.) from subterranean formations adjacent a borehole or a wellbore. The example coring shafts generally include a cylindrical body coupled to a coring bit having a leading edge (e.g., bit face) to contact and penetrate a subterranean formation to be sampled. The cylindrical body has an internal cavity defined at least in part by an inner surface of the cylindrical body to collect the samples. In addition, as described in greater detail herein, in certain embodiments, the sidewall coring tools may have a static sleeve disposed within the internal cavity defined at least in part by the inner surface of the cylindrical body of the respective coring shaft.

Referring now to the drawings, FIG. 1 is a schematic view of an embodiment of a coring system 10 utilizing a sidewall coring tool assembly 12 as described in greater detail herein. As illustrated, the sidewall coring tool assembly 12 may be used in a drilled well to obtain core samples from a downhole or subterranean geologic formation 14. In operation, the sidewall coring tool assembly 12 may be lowered into a borehole 16 defined by a bore wall 18, commonly referred to as the sidewall 18. As illustrated, in certain embodiments, the sidewall coring tool assembly 12 may be connected by one or more electrically conducting cables 20 (e.g., wireline cables) to a surface unit 22, which may include (or otherwise be operatively coupled to) a control panel 24 and a monitor 26. In general, the surface unit 22 is configured to provide electrical power to the sidewall coring tool assembly 12, to monitor the status of downhole coring and activities of other downhole equipment, and to control the activities of the sidewall coring tool assembly 12 and other downhole equipment. While FIG. 1 illustrates the sidewall coring tool assembly 12 deployed at the end of a wireline cable 20, in other embodiments, a sidewall coring tool assembly 12 may be deployed in a well using any known or future-developed conveyance means, including drill pipe, coiled tubing, etc.

In certain embodiments, the sidewall coring tool assembly 12 may be contained within an elongate housing suitable for being lowered into and retrieved from the borehole 16. In certain embodiments, the sidewall coring tool assembly 12 may include an electronic sonde 28, a mechanical sonde 30, and a core magazine 32. In general, the electronic sonde 28 includes electronics that enable the sidewall coring tool assembly 12 to communicate with the surface unit 22 (e.g., though the cables 20) and to control coring operations of the sidewall coring tool assembly 12 in accordance with such communication. In addition, the mechanical sonde 30 includes mechanical components that enable the sidewall coring tool assembly 12 to retrieve core samples through the sidewall 18 of the wellbore 16, as described in greater detail, and to store the retrieved core samples (e.g., as sequentially retrieved) in the core magazine 32.

In particular, as described in greater detail herein, the mechanical sonde 30 contains a coring assembly including at least one coring motor 34 powered through the cables 20, a (generally cylindrical) coring shaft 36 having a distal, open end 38 for cutting and receiving a core sample from a formation 14 into an internal cavity formed radially within the cylindrical coring shaft 36, and a mechanical linkage (not shown) for deploying and retracting the coring shaft 36 relative to the sidewall coring tool assembly 12 and for rotating the coring shaft 36 against the sidewall 18. FIG. 1 illustrates the sidewall coring tool assembly 12 in an active, cutting configuration. For example, the sidewall coring tool assembly 12 is positioned adjacent the formation 14 and urged firmly against the sidewall 18 of the wellbore 16 by upper and lower anchoring shoes 40, 42, which are extended from a side of the sidewall coring tool assembly 12 opposing the coring shaft 36. As described in greater detail herein, the distal, open end 38 of the coring shaft 36 may be rotated via the coring motor 34 against the formation 14 to cut a core sample from the formation 14.

Figure 2C:
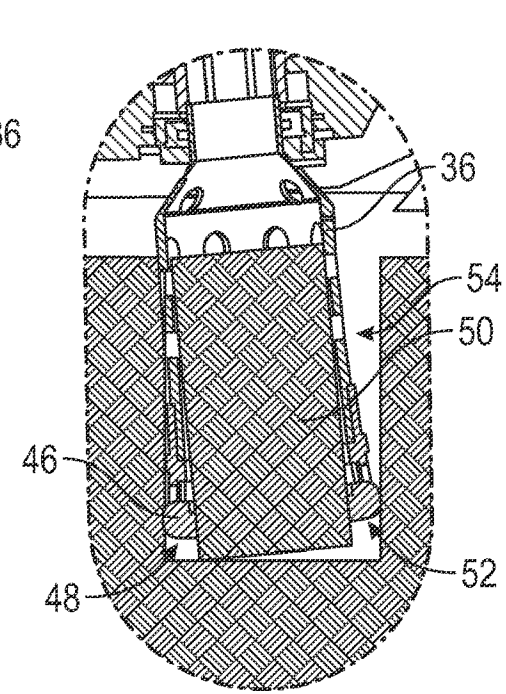
FIGS. 2A through 2C are schematic views of a sidewall coring tool assembly including close-up views of a coring shaft and coring bit, according to one or more embodiments of the present disclosure.
Figure 2B:
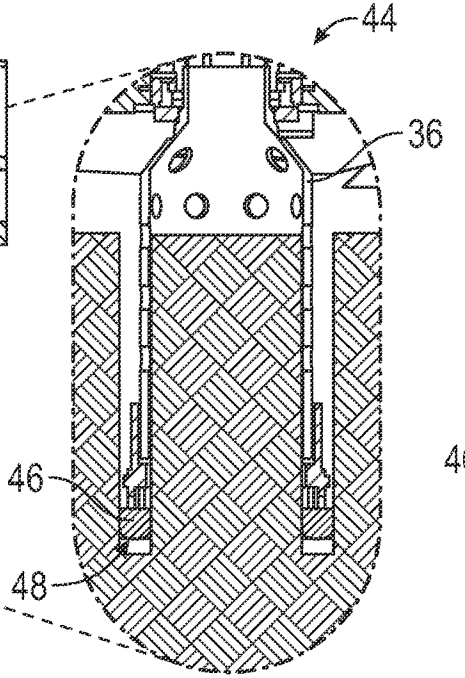
Figure 2A:
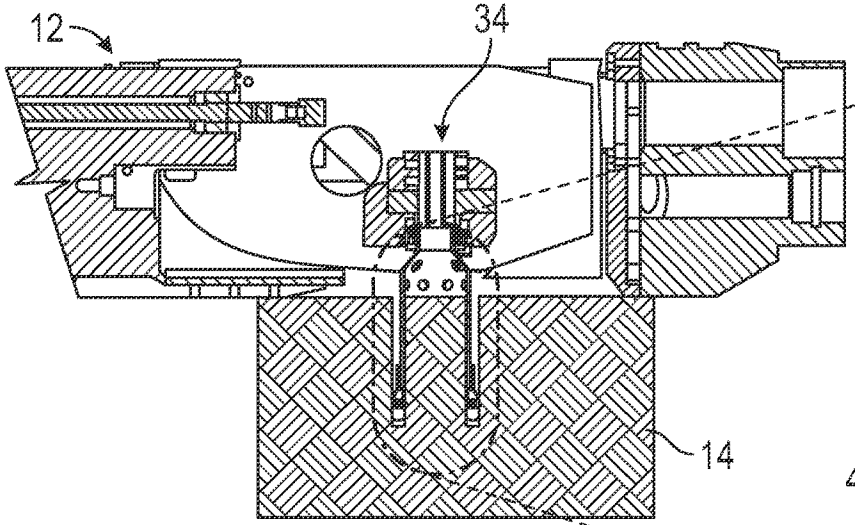

FIGS. 2A through 2C are schematic views of a sidewall coring tool assembly 12 including close-up views of the coring shaft 36 and the coring bit 46 of the sidewall coring tool assembly 12. A coring shaft 36 coupled via a (generally cylindrical) coring motor shaft 44 of the coring motor 34 transfers rotary power and weight-on-bit (WOB) during the cutting operation. The coring shaft 36 is attached to the coring motor shaft 44 at a first axial end and to a coring bit 46 at a second axial end. In general, the coring bit 46 includes a bit face 48 (e.g., rock and bit interface) that contacts the formation 14. In certain embodiments, a clearance between an internal diameter of the coring shaft 36 and an outer diameter of the core plug 50 forms an internal annulus 52, which provides an annular path for mud and cutting debris. Similarly, a clearance between an external diameter of the coring shaft 36 and an internal diameter of the formation 14 forms an external annulus 54, which provides another annular path for mud and cutting debris.

Without a defined or directed flow, the cuttings are free to move in any direction in the internal and external annuli, allowing the cuttings and debris to keep circulating in the internal annulus 52 and/or the external annulus 54. Depending on the properties of the drilling mud and formation 14, the cutting debris may clump around the coring bit 46 and/or the coring shaft 36, commonly referred to as bit balling. Bit balling may cause drilling problems like reduced rate of penetration or stalling of the coring motor 34. Too much bit balling could also cause the coring bit 46 to get stuck in the formation 14.

As such, for the coring bit 46 to advance into the formation 14, the cuttings generated by the coring bit 46 need to move away from the bit face 48 of the coring bit 46. In typical coring operations, the cutting action takes place in static wellbore fluid in contrast with other industrial cutting operations that use a flow of fluid to cool the tool and move cuttings away from the bit face. Again, when cutting without active fluid flow, the cuttings tend to accumulate around the coring bit and the coring shaft, which can prevent fluid from reaching the bit face, reduce the rate of penetration, and result in jamming or stalling of the coring bit. Conventional coring bits may provide a restricted path to move the cuttings away from the bit face, which may not allow for the free flow of debris away from the bit face and results in the cuttings staying at the bit face where they are further reduced in size in what has been dubbed "re-grinding of cuttings" or "cutting of cuttings." This situation reduces the overall efficiency of the drilling operation. Coring tools may employ perforations in the coring shaft to allow drilling mud and cutting debris to enter and exit between the internal and external annuli. During rotation of the coring shaft, the perforations create turbulence that causes movement of the drilling mud and cutting debris; however, there is no defined or directed flow of the mud or debris.

Figure 3A:
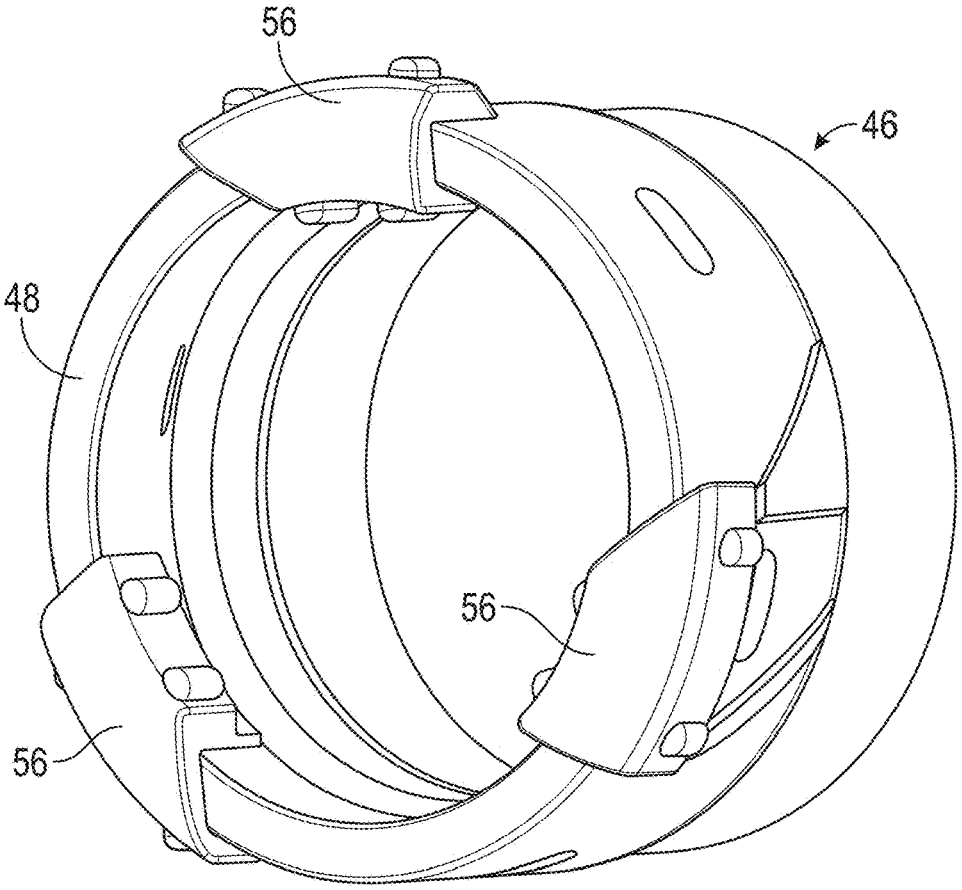
FIGS. 3A and 3B illustrate an example coring bit in perspective and front views, respectively, according to one or more embodiments of the present disclosure.

Accordingly, the embodiments illustrated in FIGS. 3A through 6C herein generally include features whereby cuttings may be carried away from the coring bit 46 without defined or directed flow of the mud being created. For example, FIG. 3A illustrates an example coring bit 46 with a bit face 48 in accordance with the present disclosure. As illustrated, in certain embodiments, the coring bit 46 may include a plurality of cutting elements or pads 56 disposed about a circumference of the coring bit 46 at the bit face 48. In the embodiment illustrated in FIG. 3A, the coring bit 46 includes three cutting pads 56. However, the coring bit 46 may include any number of cutting pads 56 including, but not limited to, two cutting pads, four cutting pads, five cutting pads, or six or more cutting pads.

Figure 3B:
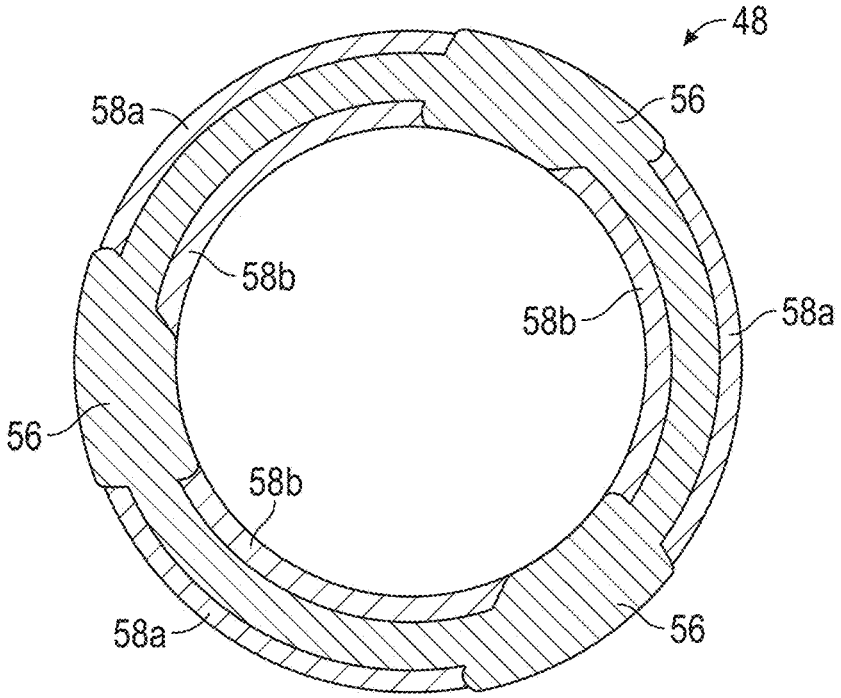

FIG. 3B illustrates the coring bit face 48 of the coring bit 46 illustrated in FIG. 3A with a passage area 58 created by the coring bit 46 as it cuts into the formation 14. In particular, the coring bit 46 and the coring shaft 36 of the present disclosure allow space for cuttings to move away from the bit face 48 (e.g., into the wellbore 16) when drilling into the formation 14 without active fluid flow. As illustrated in FIG. 3B, in certain embodiments, the passage area 58 includes an outer passage area 58*a* disposed between an outer surface of the coring shaft 36 and the formation 14 (e.g., formed by the cutting pads 56 of the coring bit 46 circumferentially between the cutting pads 56 radially exterior to the coring bit 46), and an inner passage area 58*b* disposed between an inner surface of the coring shaft 36 and an outer surface of a core plug 50 drilled from the formation 14 (e.g., formed by the cutting pads 56 of the coring bit 46 circumferentially between the cutting pads 56 radially interior to the coring bit 46). In the embodiment illustrated in FIG. 3B, the outer and inner passage areas 58*a*, 58*b* include three portions spanning between each of the three cutting pads 56. However, the coring bit 46 may include any number of cutting pads 56 and, thus, any number of corresponding sets of outer and inner passage areas 58*a*, 58*b* including, but not limited to, two sets of outer and inner passage areas 58*a*, 58*b*, four sets of outer and inner passage areas 58*a*, 58*b*, five sets of outer and inner passage areas 58*a*, 58*b*, or six or more sets of outer and inner passage areas 58*a*, 58*b*.

Figure 4A:
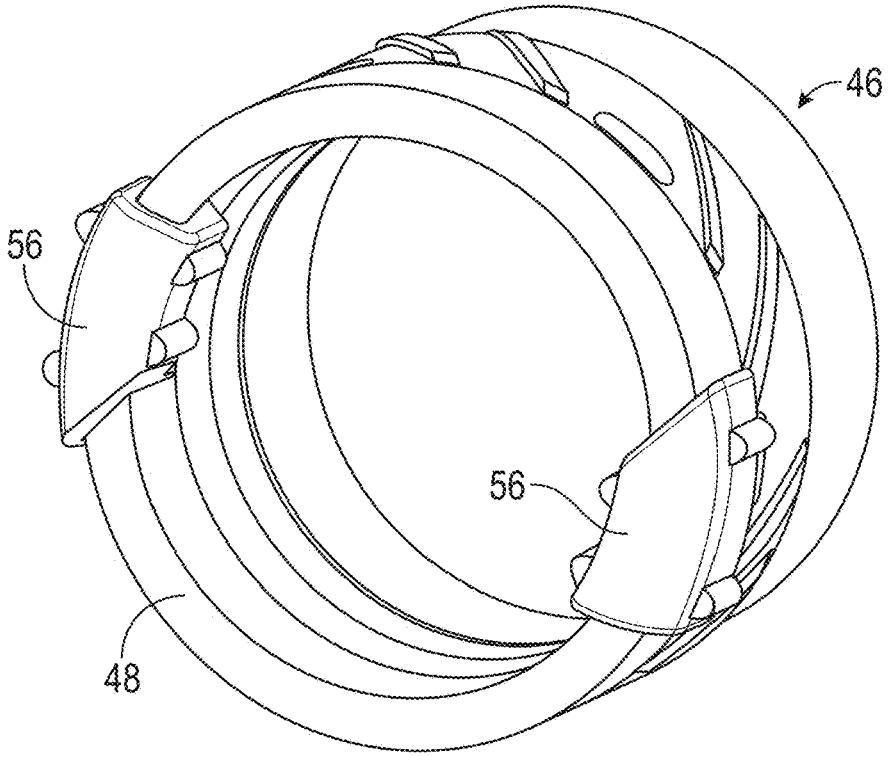
FIGS. 4A and 4B illustrate another example coring bit in perspective and front views, respectively, according to one or more embodiments of the present disclosure.

FIG. 4A illustrates another example coring bit 46 with a bit face 48 in accordance with the present disclosure. As illustrated, in certain embodiments, the coring bit 46 may again include a plurality of cutting elements or pads 56 disposed about a circumference of the coring bit 46 at the bit face 48. In the embodiment illustrated in FIG. 4A, the coring bit 46 includes two cutting pads 56. However, the coring bit 46 may include any number of cutting pads 56 including, but not limited to, three cutting pads, four cutting pads, five cutting pads, or six or more cutting pads.

Figure 4B:
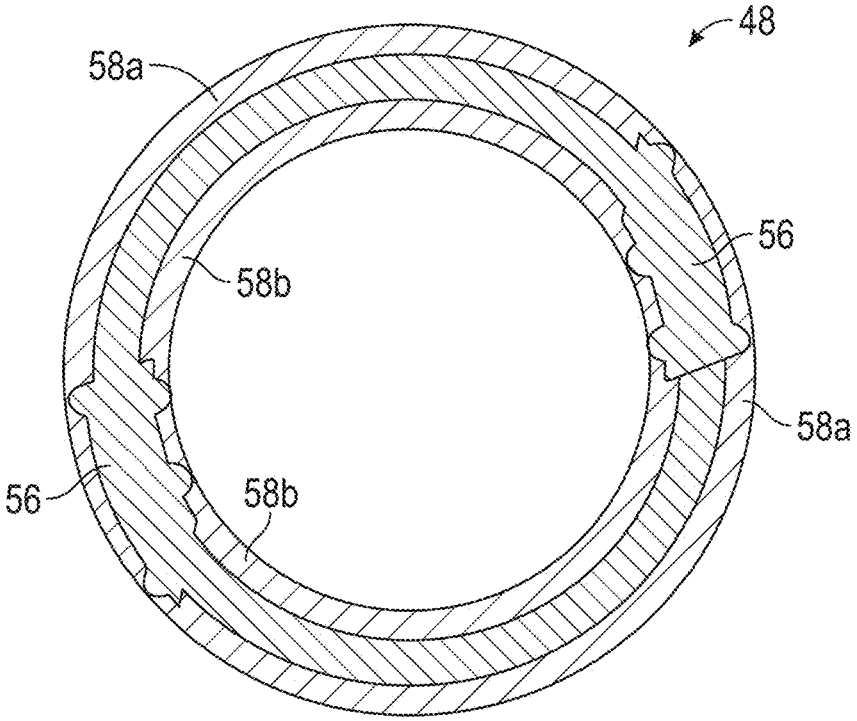

FIG. 4B illustrates the coring bit face 48 of the coring bit 46 illustrated in FIG. 4A with a passage area 58 created by the coring bit 46 as it cuts into the formation 14. In particular, the coring bit 46 and the coring shaft 36 of the present disclosure allow space for cuttings to move away from the bit face 48 (e.g., into the wellbore 16) when drilling into the formation 14 without active fluid flow. As illustrated in FIG. 4B, in certain embodiments, the passage area 58 includes an outer passage area 58*a* disposed between an outer surface of the coring shaft 36 and the formation 14 (e.g., formed by the cutting pads 56 of the coring bit 46 circumferentially between the cutting pads 56 radially exterior to the coring bit 46), and an inner passage area 58*b* disposed between an inner surface of the coring shaft 36 and an outer surface of core plug 50 drilled from the formation 14 (e.g., formed by the cutting pads 56 of the coring bit 46 circumferentially between the cutting pads 56 radially interior to the coring bit 46). In the embodiment illustrated in FIG. 4B, the outer and inner passage areas 58*a*, 58*b* include two portions spanning between each of the cutting pads 56. However, the coring bit 46 may include any number of cutting pads 56 and, thus, any number of corresponding sets of outer and inner passage areas 58*a*, 58*b* including, but not limited to, three sets of outer and inner passage areas 58*a*, 58*b*, four sets of outer and inner passage areas 58*a*, 58*b*, five sets of outer and inner passage areas 58*a*, 58*b*, or six or more sets of outer and inner passage areas 58*a*, 58*b*.

A debris escape area percentage may be calculated for the coring bit 46 of FIGS. 3A, 3B, 4A, and 4B or other alternative embodiments having a different number of cutting pads 56. Regardless of the number of cutting pads 56 used, the geometry of the cutting pads 56 may be adjusted to maintain a certain bit tooth area, which can be measured. The debris escape area percentage may be calculated as the open passage area 58 (both the outer passage area 58*a* and the inner passage area 58*b*) divided by the total annulus area where all measurements are taken at the bit face 48 (i.e., a cross sectional plane that is orthogonal to a central axis of the coring bit 46 and the coring shaft 36 at the bit face 48). The total annulus area includes both the bit tooth area plus the combined open passage area 58 and can be calculated by:

$$\pi\left[\left(\frac{OD}{2}\right)^2-\left(\frac{ID}{2}\right)^2\right] \quad \text{(Eq. 1)}$$

where OD is the maximum outer diameter of the cutting pads 56 of the coring bit 46 and ID is the minimum inner diameter of the cutting pads 56 of the coring bit 46. The total open passage area 58 may be calculated by subtracting bit tooth area (measured) from the annulus area (calculated, see above). For example, the coring bit 46 of FIGS. 3A and 3B may have a debris escape area percentage of 30 percent or greater and the coring bit 46 of FIGS. 4A and 4B may have a debris escape area percentage of 35 percent or greater. In other embodiments with varying number of cutting pads 56, the debris escape area percentage may be 15 percent or greater, 20 percent or greater, 25 percent or greater, 37 percent or greater, and up to 50 percent or 60 percent.

Figure 5A:
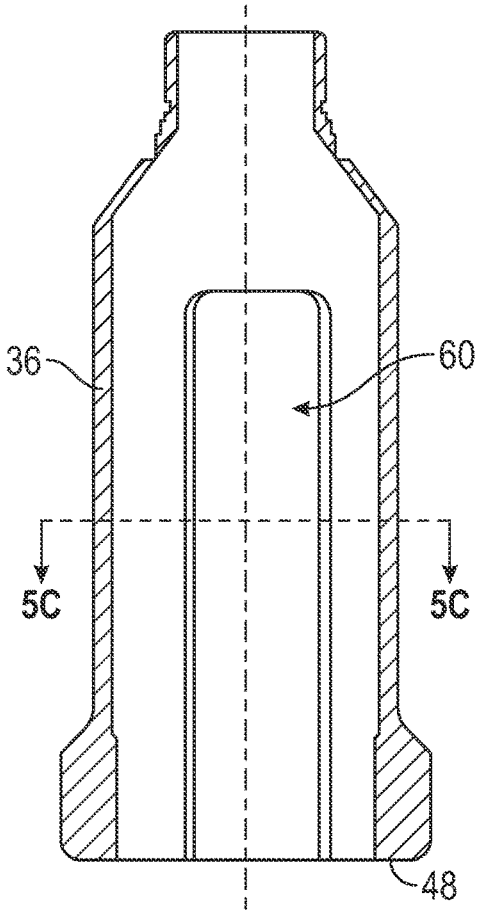
FIGS. 5A through 5C illustrate an example coring shaft and bit face with cutout slots in a partial cross-sectional side view, a front view, and a cross section view, respectively, according to one or more embodiments of the present disclosure.
Figure 5C:
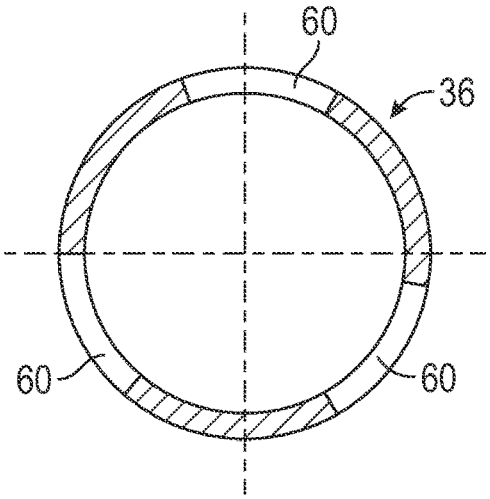
Figure 5B:
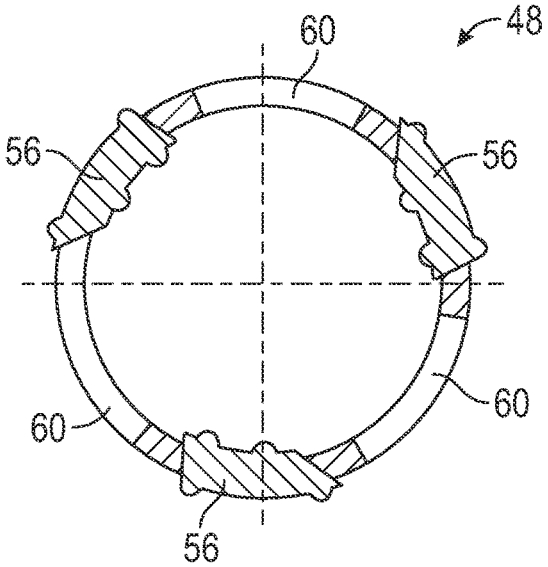

FIGS. 5A through 5C illustrate an example coring shaft 36, which may include cutout slots 60 through the coring shaft 36 and extending at least partially axially along the coring shaft 36 to further enable the movement of solids or cuttings away from the bit face 48 of the coring bit 46 (e.g., into the wellbore 16). In certain embodiments, the cutout slots 60 may be straight or longitudinal (e.g., extending generally longitudinally along the coring shaft 36) or the cutout slots 60 may have a helical shape. In the illustrated embodiment, the coring shaft 36 includes three cutout slots 60 that intersect the bit face 48 of the coring bit 46 and allow a direct path for cuttings into each cutout slot 60. However, the coring shaft 36 may include any number of cutout slots 60 including, but not limited to, two cutout slots, four cutout slots, or five or more cutout slots, as long as structural integrity of the coring shaft 36 is maintained. Furthermore, in certain embodiments, the cutout slots 60 may stop short of the bit face 48 of the coring bit 46 instead of intersecting the bit face 48.

In general, the addition of cutout slots 60 provides more space for the cuttings and reduces friction between the coring shaft 36 and the formation 14, allowing for an increase in torque available at the bit face 48 of the coring bit 46. The cutout slots 60 also allow cuttings built up on the internal diameter of the coring shaft 36 (i.e., around the core plug 50, see FIG. 3B) to easily move to the outside of coring shaft 36, further increasing the torque available to the bit face 48 of the coring bit 46. As such, the embodiments of this disclosure provide an increase in the available passageways for the cuttings while maintaining the bit's ability to transmit torque and weight on the coring bit 46 and complete a tilt break operation to sever the core 50 from the parent formation 14 (see, e.g., the cutaway portion of FIG. 2).

Figure 6A:
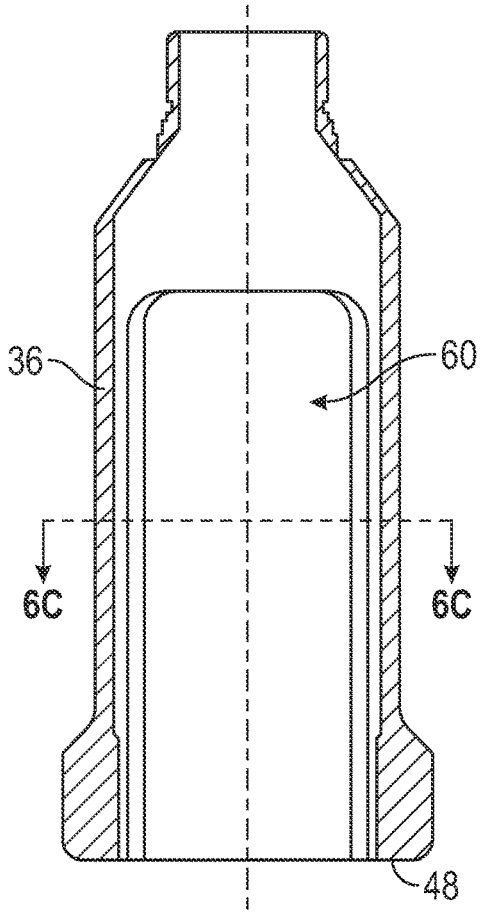
FIGS. 6A through 6C illustrate another example coring shaft and bit face with cutout slots in a partial cross-sectional side view, a front view, and a cross section view, respectively, according to one or more embodiments of the present disclosure.
Figure 6C:
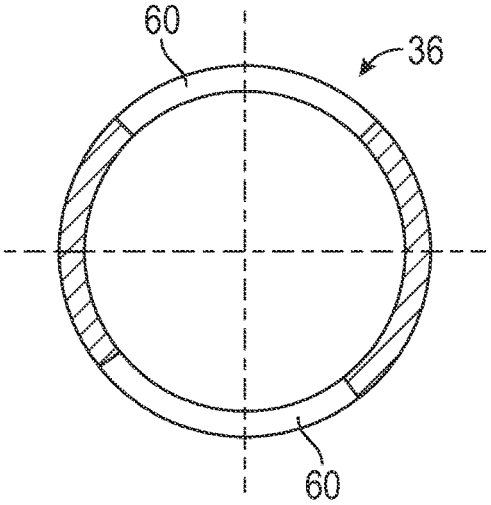
Figure 6B:
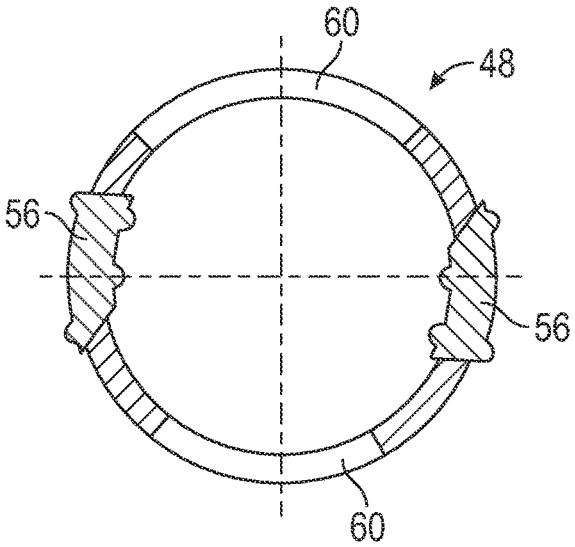

FIGS. 6A through 6C illustrate another example coring shaft 36, which may also include cutout slots 60 through the coring shaft 36 to further enable the movement of solids or cuttings away from the bit face 48 of the coring bit 46 (e.g., into the wellbore 16). In certain embodiments, the cutout slots 60 may be straight or longitudinal or the cutout slots 60 may have a helical shape. In the illustrated embodiment, the coring shaft 36 includes two cutout slots 60 that intersect the bit face 48 of the coring bit 46 and allow a direct path for cuttings into each cutout slot 60. However, the coring shaft 36 may include any number of cutout slots 60 including, but not limited to, three cutout slots, four cutout slots, or five or more cutout slots, as long as structural integrity of the coring shaft 36 is maintained. Furthermore, in certain embodiments, the cutout slots 60 may stop short of the bit face 48 of the coring bit 46 instead of intersecting the bit face 48. In general, the addition of cutout slots 60 provides more space for the cuttings and reduces friction between the coring shaft 36 and the formation 14, allowing for an increase in torque available at the bit face 48 of the coring bit 46. The cutout slots 60 also allow cuttings built up on the internal diameter of the coring shaft 36 (i.e., around the core plug 50, see FIG. 4B) to easily move to the outside of coring shaft 36, further increasing the torque available to the bit face 48 of the coring bit 46.

As such, the embodiments of this disclosure provide an increase in the available passageways for the cuttings while maintaining the bit's ability to transmit torque and weight on the coring bit 46 and complete a tilt break operation to sever the core 50 from the parent formation 14 (see, e.g., the cutaway portion of FIG. 2). Furthermore, in addition to providing more space for cuttings to move away from the coring bit 46, the torque needed to drive the coring bit 46 is lessened as the surface area of the coring bit 46 contacting or engaging the formation 14 is reduced. The increased space for cuttings to move away from the coring bit 46 (e.g., into the wellbore 16) may result from a reduced number of cutting pads 56, adjusted and reduced geometry of each cutting pad 56, the cutout slots 60 in the coring shaft 36, and any combination thereof.

Figure 7A:
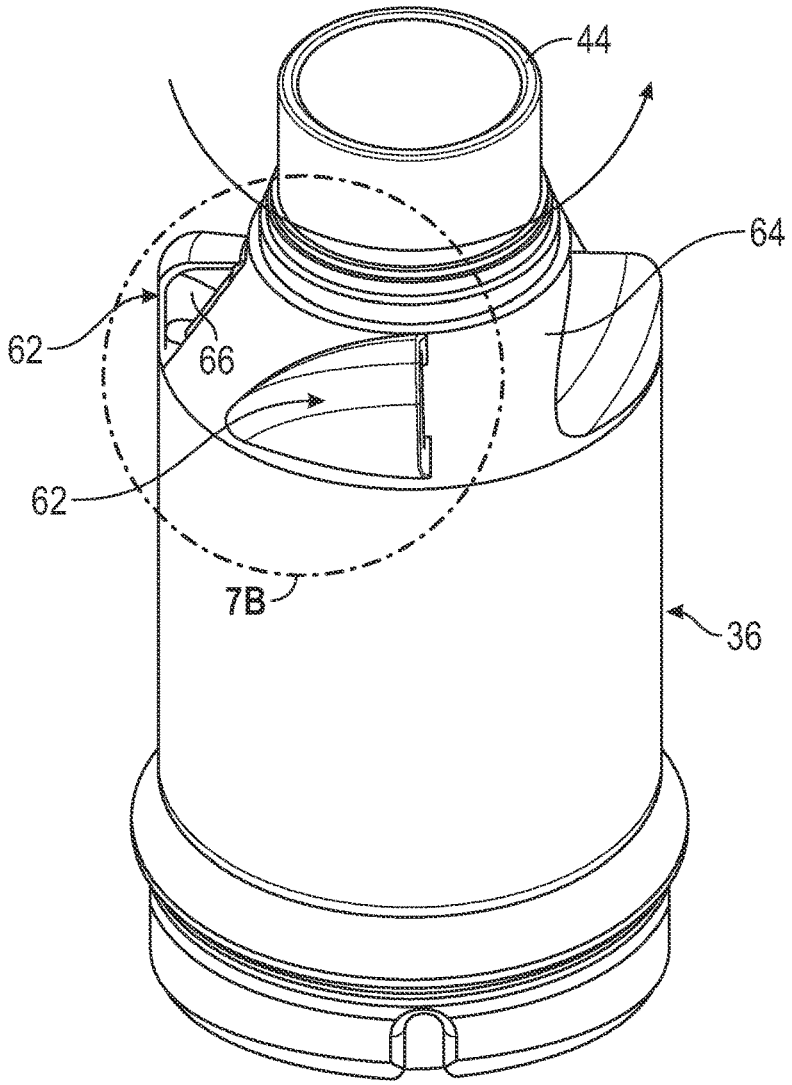
FIGS. 7A through 7C illustrate a side view and close-up external and internal views of an inlet feature on a coring shaft, according to one or more embodiments of the present disclosure.
Figure 7B:
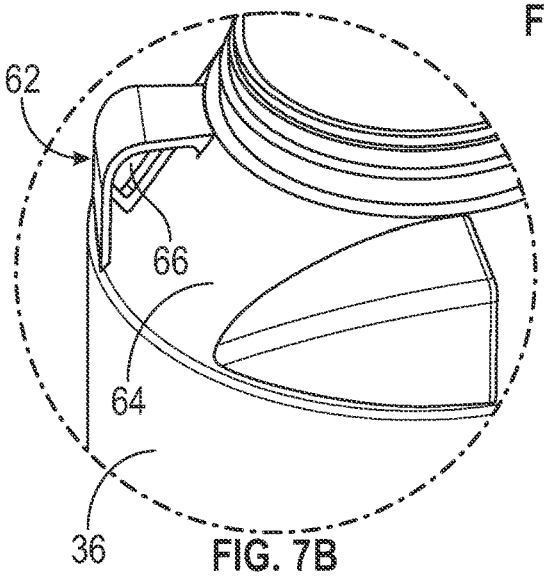
Figure 7C:
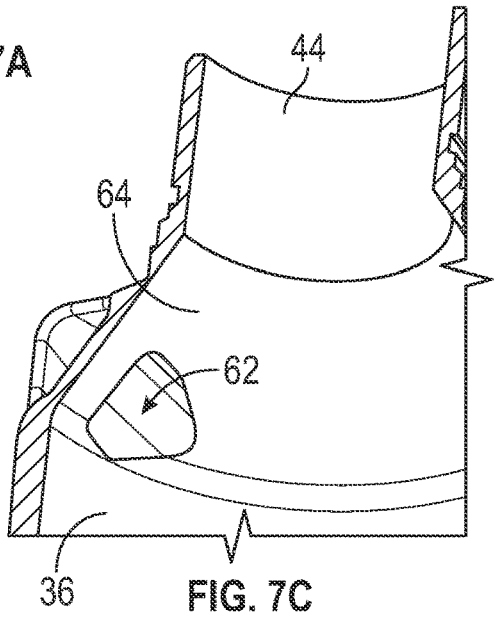

As opposed to the embodiments illustrated in FIGS. 3A through 6C, the embodiments illustrated in FIGS. 7A through 12 include various features that create a defined or directed flow of mud into and around the coring shaft 36 and the coring bit 46. For example, FIGS. 7A through 7C illustrate a side view (FIG. 7A) and close-up exterior (FIG. 7B) and interior (FIG. 7C) views of an example coring shaft 36. As illustrated, in certain embodiments, the coring shaft 36 may include inlets or scoops 62 at a rear end of the coring shaft 36 that direct flow of the drilling mud to remove cutting debris from the bit face 48 of the coring bit 46. In certain embodiments, the scoops 62 may be located at the rear end of the coring shaft 36 (e.g., closer to the coring motor shaft 44 than the coring bit 46, for example, on an angled intermediate shaft portion 64 at an axial end of the coring shaft 36 between the larger coring shaft 36 and the smaller motor shaft 44) to form a short conduit that connects the drilling mud inside the coring shaft 36 to the drilling mud outside the coring shaft 36 and to the mud in the wellbore 16 near the coring motor 34. Although primarily illustrated and described herein as being disposed on the generally conical intermediate shaft portion 64 (e.g., on an external surface of the coring shaft 36 that extends from a first axial end of the coring shaft 36 that couples to the coring motor shaft 44), in other embodiments, the scoops 62 may be disposed on the generally cylindrical main portion of the coring shaft 36 (e.g., on an external surface of the coring shaft 36 that extends from a second axial end of the coring shaft 36 that couples to the coring bit 46).

Figure 8C:
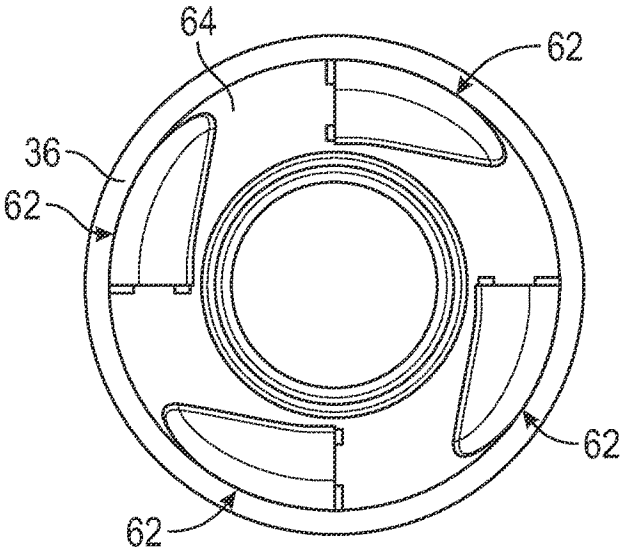
FIGS. 8A through 8C illustrate a top sectional view of a coring shaft, according to one or more embodiments of the present disclosure.
Figure 8B:
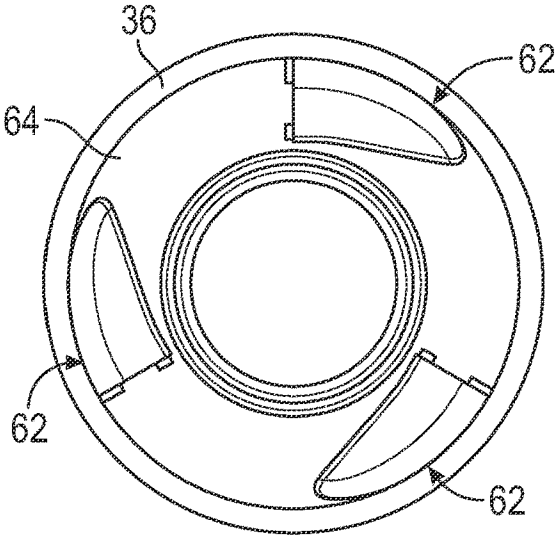
Figure 8A:
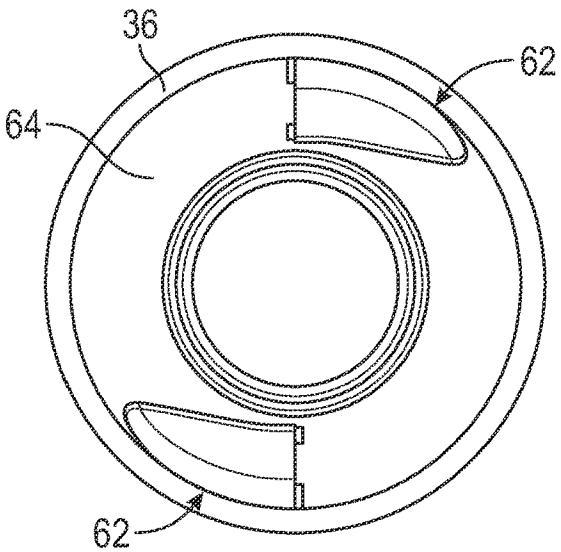

In certain embodiments, the coring shaft 36 may have one or more inlets or scoops 62. As illustrated in FIGS. 8A through 8C, the number of inlets or scoops 62 may include, but is not limited to two, three, or four inlets or scoops 62. In alternative embodiments, the coring shaft 36 may include five or more inlets or scoops 62. Each scoop 62 includes an opening 66 facing the direction of the rotation of the coring shaft 36 (see FIG. 7A) at an angle that is not orthogonal to a longitudinal axis of the coring shaft 36, and the opening 66 of each scoop 62 forms the beginning of the short conduit from the exterior of the coring shaft 36 to the interior of the coring shaft 36.

Each scoop 62 facilitates drawing in the drilling mud from the borehole 16 and directing this suctioned drilling mud along an internal wall of the coring shaft 36. Each scoop 62 may also direct the drilling mud toward the coring bit 46 and away from the coring motor 34. In certain embodiments, the flow of drilling mud may be directed toward the bit face 48 of the coring bit 46 and between the internal annulus 52 formed between the interior of the coring shaft 36 and the exterior of the core plug 50 (see FIG. 2). The flow of the drilling mud may be controlled through balancing the design configuration of the internal and external annuli 52, 54. In an alternative embodiment, each scoop 62 may direct the drilling mud toward the coring motor 34 and away from the coring bit 46 to direct the flow from the external annulus 54 to the internal annulus 52 (see, e.g., FIG. 7C).

Furthermore, the plurality of scoops 62 may be tightly spaced or sparsely distributed circumferentially along the outer diameter of the coring shaft 36. In certain embodiments, the plurality of scoops 62 may be symmetrically or evenly spaced (e.g., distributed) circumferentially about the outer diameter (e.g., external surface) of the coring shaft 36. In other embodiments, the plurality of scoops 62 may be asymmetrically or unevenly spaced (e.g., distributed) circumferentially about the outer diameter (e.g., external surface) of the coring shaft 36.

Figure 9A:
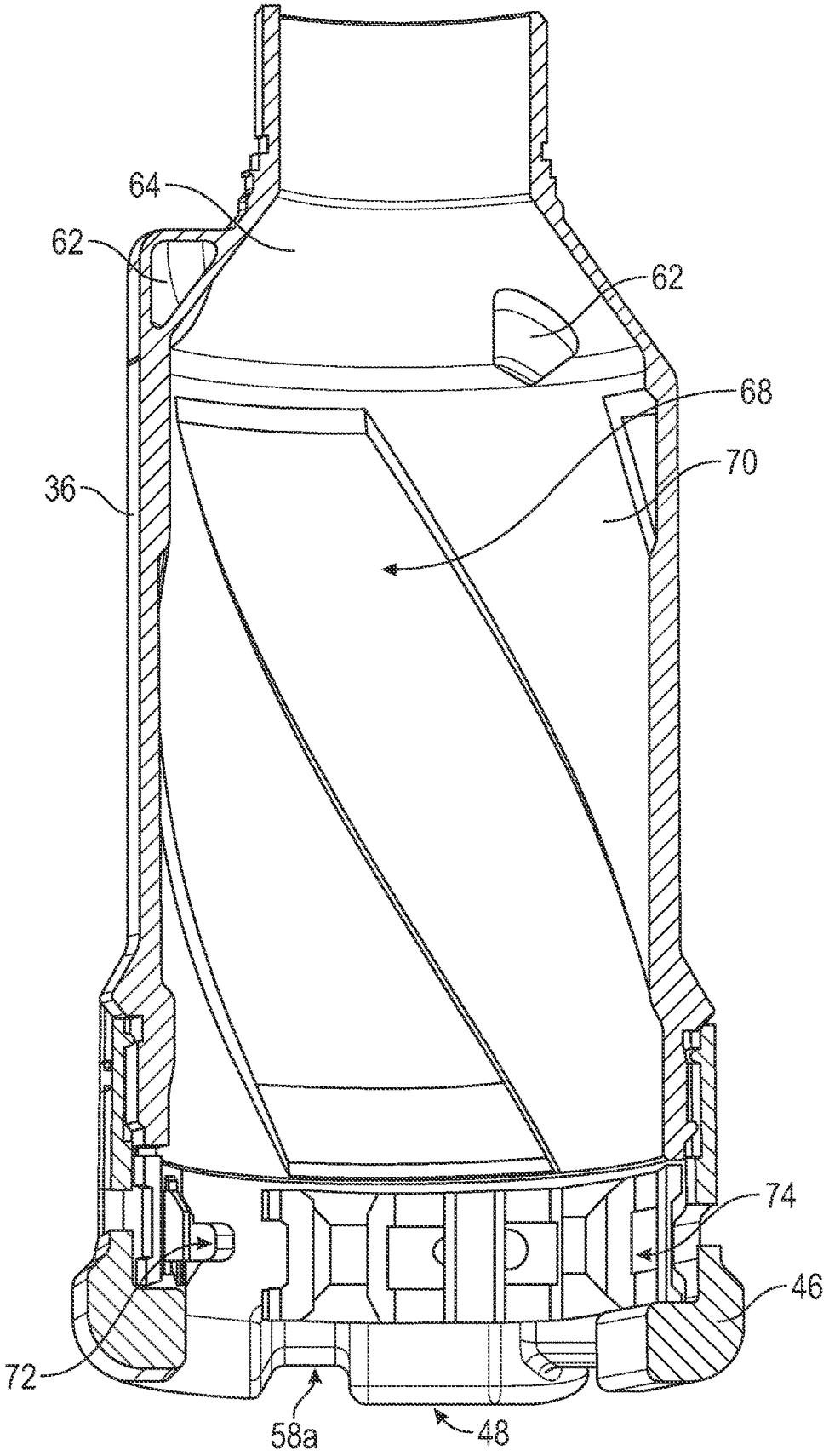
FIGS. 9A through 9C are sectional views of a coring shaft and coring bit, according to one or more embodiments of the present disclosure.
Figure 9B:
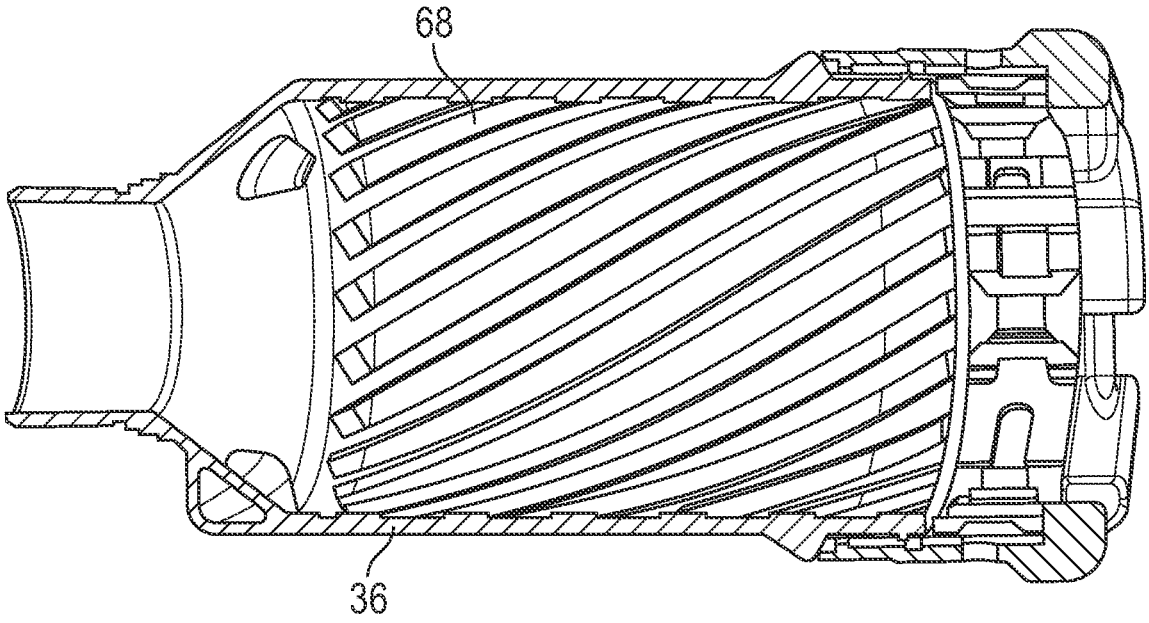
Figure 9C:
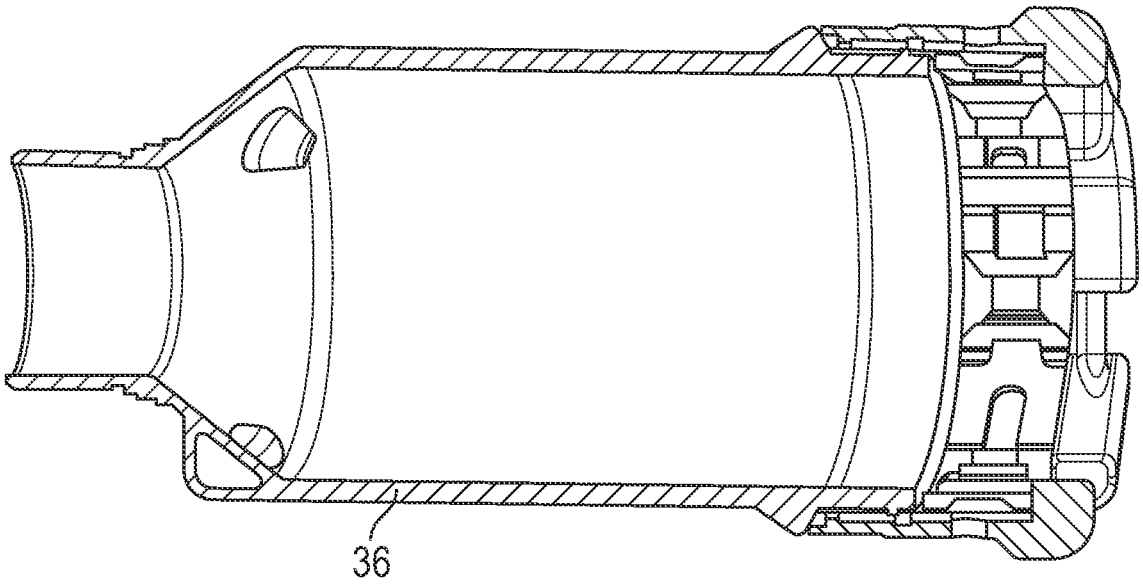

Referring now to FIG. 9A, in certain embodiments, the drilling mud may be directed through the internal annulus 52 with a plurality of internal grooves 68 disposed on an internal surface 70 of the coring shaft 36. In certain embodiments, the internal grooves 68 may be helically oriented on any appropriate lay angle including, but not limited to, between greater than 0 degrees and less than 90 degrees in either a clockwise or counterclockwise direction. In addition, in certain embodiments, the internal grooves 68 may be relatively wide (FIG. 9A) or relatively narrow (FIG. 9B) or any width therebetween. In addition, in certain embodiments, the internal surface 70 of the coring shaft 36 may not include any internal grooves 68 (FIG. 9C).

Furthermore, in certain embodiments, the plurality of internal grooves 68 may be tightly spaced or sparsely distributed circumferentially along the inner diameter of the coring shaft 36. In certain embodiments, the plurality of internal grooves 68 may be symmetrically or evenly spaced (e.g., distributed) circumferentially about the inner diameter (e.g., internal surface) of the coring shaft 36. In other embodiments, the plurality of internal grooves 68 may be asymmetrically or unevenly spaced (e.g., distributed) circumferentially about the inner diameter (e.g., internal surface) of the coring shaft 36. In certain embodiments, the quantity of scoops 62 may be the same or different than the quantity of internal grooves 68.

Although primarily illustrated and described herein as extending helically along an axial length of the internal surface 70 of the coring shaft 36, in other embodiments, the internal grooves 68 may instead extend generally longitudinally (e.g., within a few degrees of being truly longitudinal) along the axial length of the internal surface 70 of the coring shaft 36. Furthermore, although primarily illustrated and described herein as extending an entire axial length of the internal surface 70 of the coring shaft 36, in other embodiments, the internal grooves 68 may instead extend less than the entire axial length of the internal surface 70 of the coring shaft 36. For example, in certain embodiments, the internal grooves 68 may only extend 90%, 80%, 70%, 60%, 50%, or even less, of the entire axial length of the internal surface 70 of the coring shaft 36.

In addition, as illustrated in FIG. 9A, in certain embodiments, the coring shaft 36 and/or the coring bit 46 may further include junk slots 72 at a front axial end (e.g., near the coring bit 46) of the coring shaft 36 (FIG. 9A). The junk slots 72 may allow drilling mud and/or debris to pass therethrough. In addition, as also illustrated in FIG. 9A, in certain embodiments, the coring bit 46 may include an inner core catcher ring 74 that facilitates capture of the core plugs 50 described herein.

In addition, as described in greater detail herein, in operation, the coring motor 34 rotates and the scoops 62 draw the drilling mud from the wellbore 16 into the coring shaft 36. The internal annulus geometry (with or without internal grooves 68) directs flow of the drilling mud toward the bit face 48 of the coring bit 46. As the drilling mud travels from the internal annulus 52 to the external annulus 54, the drilling mud clears cutting debris from the junk slots 72 of the coring bit 46 and from the bit face 48 of the coring bit 46. A portion of the drilling mud may also flow from the junk slots 72 to clear cutting debris deposited on the coring bit 46. In addition, the drilling mud, along with cutting debris, may flow in the external annulus 54 away from the coring bit 46 and toward the wellbore 16.

In addition, as described in greater detail herein, in certain embodiments, the sidewall coring tool assembly 12 may include a static sleeve disposed radially within the coring shaft 36 to facilitate the flow of drilling mud within the internal annulus 52 formed radially within the coring shaft 36 (and, in such embodiments, formed between the internal surface 70 of the coring shaft 36 and an external surface of the static sleeve) from the scoops 62 to the junk slots 72 and the passage areas 58 around the cutting pads 56 of the coring bit 46 to aid in the evacuation of cutting debris, as described in greater detail herein. It will be appreciated that the static sleeve described herein may remain fixed relative to the coring motor 34 of the sidewall coring tool assembly 12 whereas the coring shaft 36 rotates relative to the coring motor of the sidewall coring tool assembly 12, as described in greater detail herein.

Figure 10B:
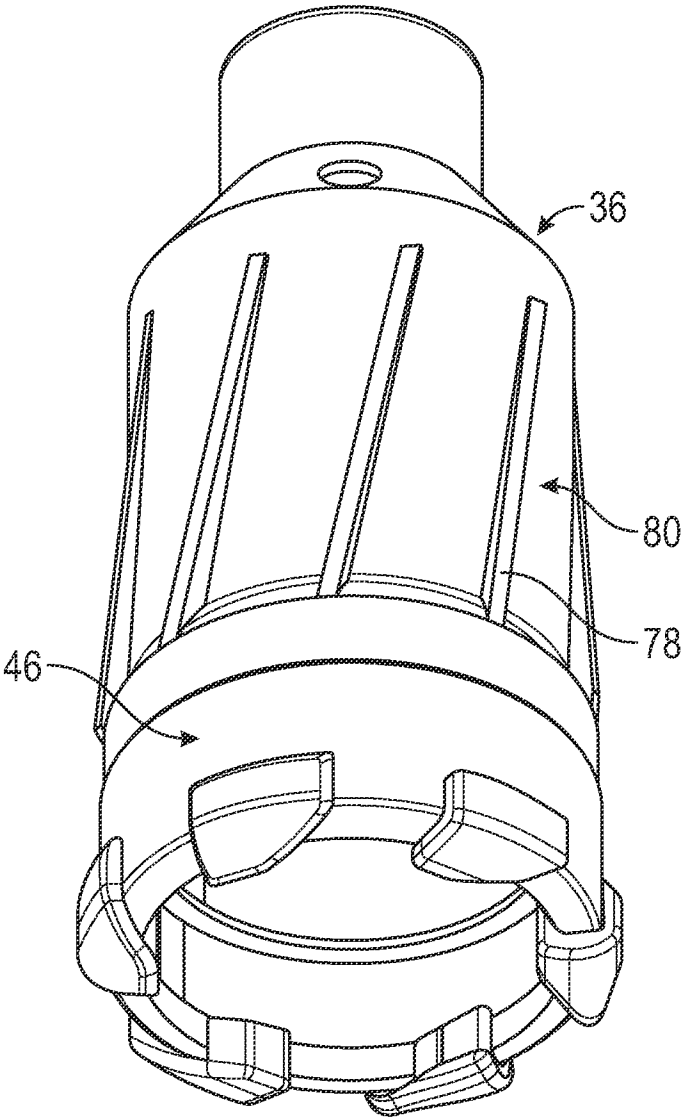
FIGS. 10A and 10B are perspective views of a coring shaft and coring bit, according to one or more embodiments of the present disclosure.
Figure 10A:
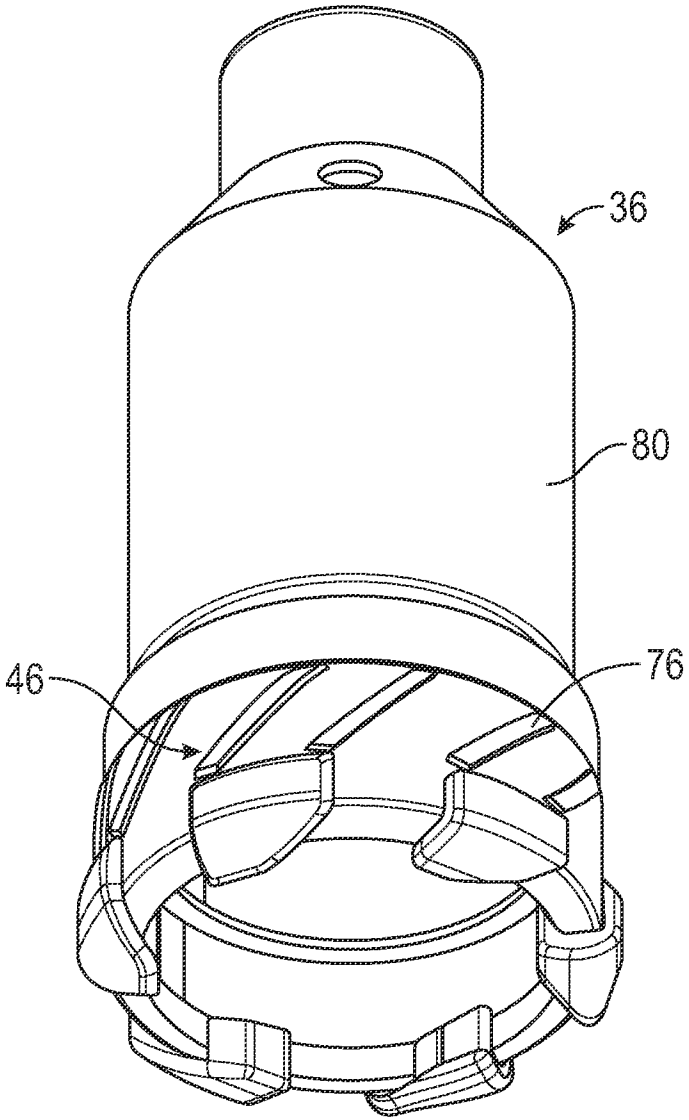

Referring now to FIGS. 10A and 10B, which are perspective views of a coring shaft 36 having a plurality of fins 76, 78 on the external surface 80 of the coring shaft 36 and/or the coring bit 46 (FIG. 10B). For example, in an embodiment, the sidewall coring tool assembly 12 may include a plurality of fins 76 on the outer diameter of the coring bit 46 to encourage movement of the drilling mud and cutting debris away from the bit face 48 of the coring bit 46 (FIG. 10A). In a further embodiment, the sidewall coring tool assembly 12 may further include a plurality of fins 78 on the outer diameter of the coring shaft 36 to facilitate movement of the drilling mud and cutting debris away from the bit face 48 of the coring bit 46 (FIG. 10B). In yet another embodiment, a plurality of fins 76, 78 may be disposed on both the coring bit 46 and on the coring shaft 36. It will be appreciated that the fins 76, 78 disposed on the coring bit 46 and/or the coring shaft 36 direct flow of the drilling mud and/or debris in the external annulus 54 of the coring shaft 36.

The plurality of fins 76, 78, whether disposed on the coring bit 46 or the coring shaft 36, may be helically oriented on any appropriate lay angle including, but not limited to, between greater than 0 degrees and less than 90 degrees in either a clockwise or counterclockwise direction. In addition, the fins 76, 78 may be relatively wide or relatively narrow or any width therebetween. Furthermore, the plurality of fins 76, 78, whether disposed on the coring bit 46 or the coring shaft 36, may be tightly spaced or sparsely distributed circumferentially along the outer diameter of the coring bit 46 and/or the coring shaft 36. In certain embodiments, the plurality of fins 76, 78 may be symmetrically or evenly spaced (e.g., distributed) circumferentially about the outer diameter (e.g., external surface) of the coring bit 46 and/or the coring shaft 36. In other embodiments, the plurality of fins 76, 78 may be asymmetrically or unevenly spaced (e.g., distributed) circumferentially about the outer diameter (e.g., external surface) of the coring bit 46 and/or the coring shaft 36. If both the coring bit 46 and the coring shaft 36 comprise a plurality of fins 76, 78, the quantity of fins 76 on the coring bit 46 may be the same or different than the quantity of fins 78 on the coring shaft 36.

Although primarily illustrated and described herein as extending helically along an axial length of the external surface 80 of the coring shaft 36 and/or the coring bit 46, in other embodiments, the fins 76, 78 may instead extend generally longitudinally (e.g., within a few degrees of being truly longitudinal) along the axial length of the external surface 80 of the coring shaft 36 and/or the coring bit 46. Furthermore, although primarily illustrated and described herein as extending an entire axial length of the respective external surface portion of the coring shaft 36 and/or the coring bit 46 (e.g., the external surface portion of the coring bit 46 for the coring bit fins 76 or the external surface portion of the coring shaft 36 for the coring shaft fins 78), in other embodiments, the fins 76, 78 may instead extend less than the entire axial length of the respective external surface portion of the coring shaft 36 and/or the coring bit 46. For example, in certain embodiments, the fins 76, 78 may only extend 90%, 80%, 70%, 60%, 50%, or even less, of the entire axial length of the respective external surface portion of the coring shaft 36 and/or the coring bit 46.

In general, the fins 76, 78 on the external surface 80 of the coring shaft 36 and/or the coring bit 46 serve a similar purpose for the external surface 80 as the internal grooves 68 serve for the internal surface 70 of the coring shaft 36. The defined or directed flow of mud through the fins 76, 78 removes cutting debris from the bit face 48 (e.g., rock and bit interface) and pushes those behind the cutting structure of the coring bit 46. The cutting debris still needs to be moved from the proximity of the coring bit 46 to the borehole in which the sidewall coring tool assembly 12 is anchored. The external fins 76, 78 on the coring bit 46 and/or the coring shaft 36 create paths for defined or directed flow in the external annulus 54 of the coring shaft 36. This helps movement of the cutting debris away from the coring bit 46 to the borehole.

Figure 11B:
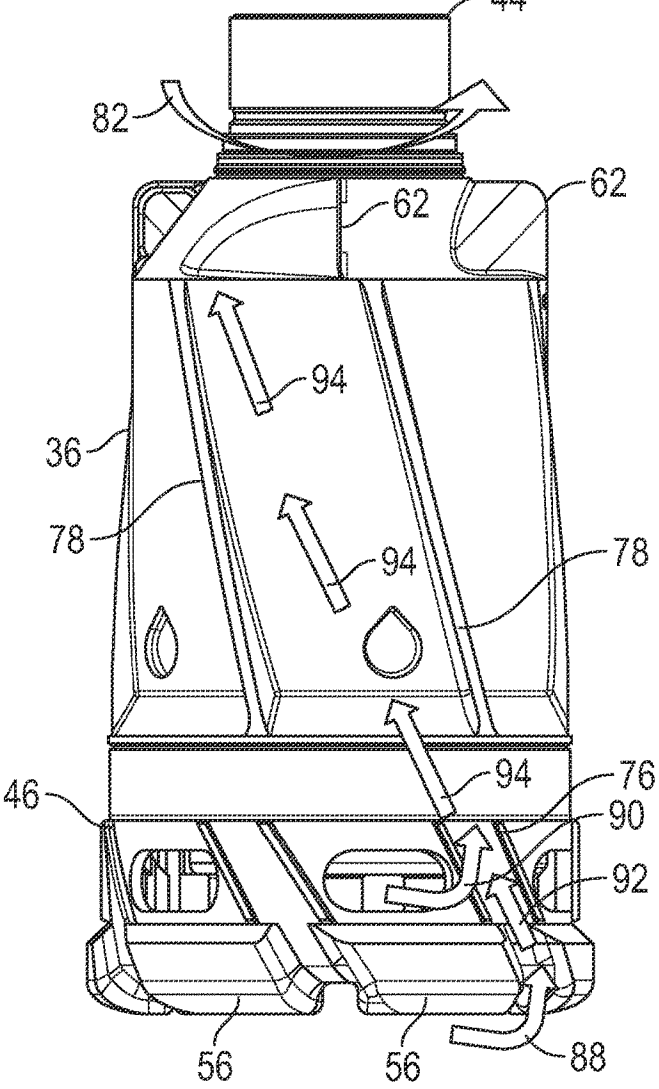
FIGS. 11A and 11B are sectional and side views, respectively, of a coring shaft and coring bit, illustrating various flow paths that create defined or directed flow, according to one or more embodiments of the present disclosure.
Figure 11A:
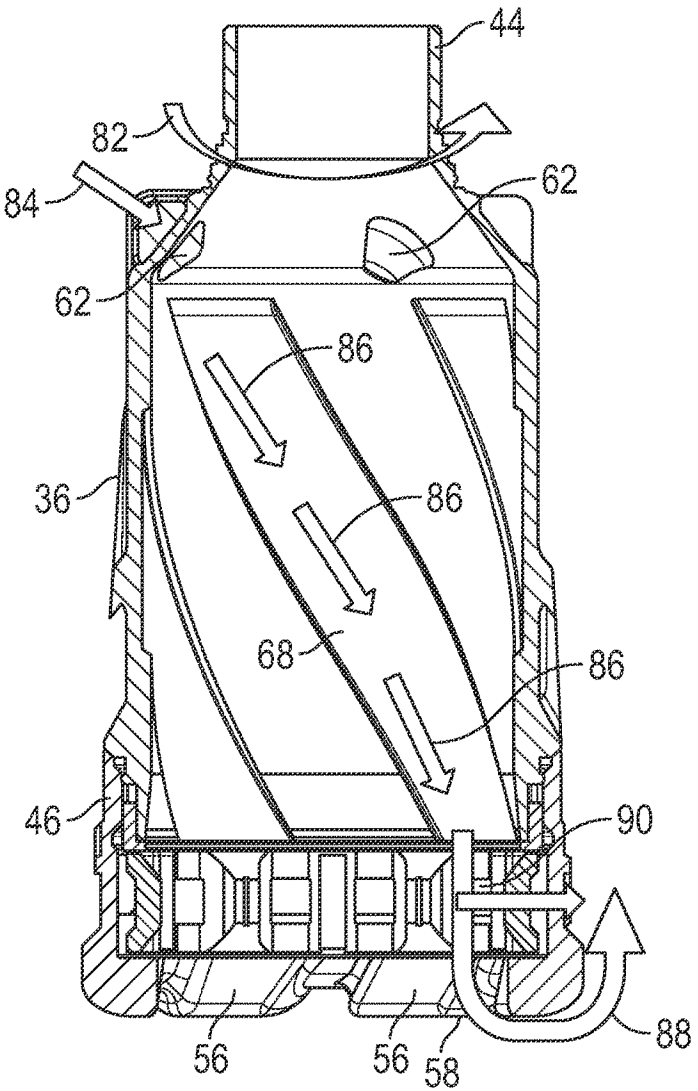

FIGS. 11A and 11B are sectional and side views, respectively, of a coring shaft 36 and coring bit 46, illustrating various flow paths that create defined or directed flow. In certain embodiments, as the coring motor 34 rotates the coring motor shaft 44 (and, by extension, the coring shaft 36), as illustrated by arrows 82, the rotational movement of the scoops 62 causes the scoops 62 to draw mud from within the borehole from one axial end of the coring shaft 36 into an interior space of the coring shaft 36, as illustrated by arrow 84. Then, the internal grooves 68 within the coring shaft 36 urge the mud at least partially axially toward the coring bit 46, as illustrated by arrow 86. Then, the mud flows axially and radially outward through the passage areas 58 formed between cutting pads 56 of the coring bit 46 and through the junk slots 72, as illustrated by arrows 88 and 90, respectively. As the mud flows over and around the coring bit 46, it carries cuttings with it. Then, as the mud moves along an outer diameter of the coring bit 46 and the coring shaft 36, it may be further assisted or guided to move axially away from the coring bit 46 along an external surface 80 formed along the coring bit 46 and the coring shaft 36 using the external fins 76, 78, as illustrated by arrows 92 and 94, respectively. In addition to moving cuttings, the flow of mud through and around the coring shaft 36 and coring bit 46 also facilitates cooling of the rock near the rock-bit interface, bit body, and the bit face 48 (e.g., rock and bit interface). The removal of heat prevents heat build-up and can help to mitigate cutter degradation, improve cutter life, and enhance cutting performance.

In addition, in certain embodiments, the scoops 62 may be oriented in such a way that, instead of drawing mud into an interior of the coring shaft 36 from the borehole, the mud may instead be drawn from within the interior of the coring shaft 36 outwardly through the scoops 62 such that all of the flow paths illustrated in FIGS. 11A and 11B are reversed. In such embodiments, the scoops 62 will direct the mud toward the coring motor 34 and away from the coring bit 46 by creating defined or directed flow of the mud from the external annulus 54 to the internal annulus 52.

In addition, as described in greater detail herein, in certain embodiments, the sidewall coring tool assembly 12 may include a static sleeve disposed radially within the coring shaft 36 to facilitate the flow of drilling mud within the internal annulus 52 formed radially within the coring shaft 36 (and, in such embodiments, formed between the internal surface 70 of the coring shaft 36 and an external surface of the static sleeve) from the scoops 62 to the junk slots 72 and the passage areas 58 around the cutting pads 56 of the coring bit 46 to aid in the evacuation of cutting debris, as described in greater detail herein. It will be appreciated that the static sleeve described herein may remain fixed relative to a stationary portion the coring motor 34 of the sidewall coring tool assembly 12 whereas the coring shaft 36 and the coring bit 46 rotate relative to the stationary portion the coring motor 34 of the sidewall coring tool assembly 12, as described in greater detail herein.

Directing flow of the drilling mud and debris in either manner, according to embodiments described herein, yields flow rates around the coring shaft 36 that are four to seven times faster as compared to flow rates in conventional coring tools. In laboratory tests, minimal to no deposits of cutting debris were observed on the coring bit 46 and the outer diameter of the coring shaft 36 of the embodiments described herein. In addition, it has also been observed that cutting times were also reduced by 16-55% (and/or rate of penetration improved by 19-81%) compared to conventional coring tools.

Figure 12:
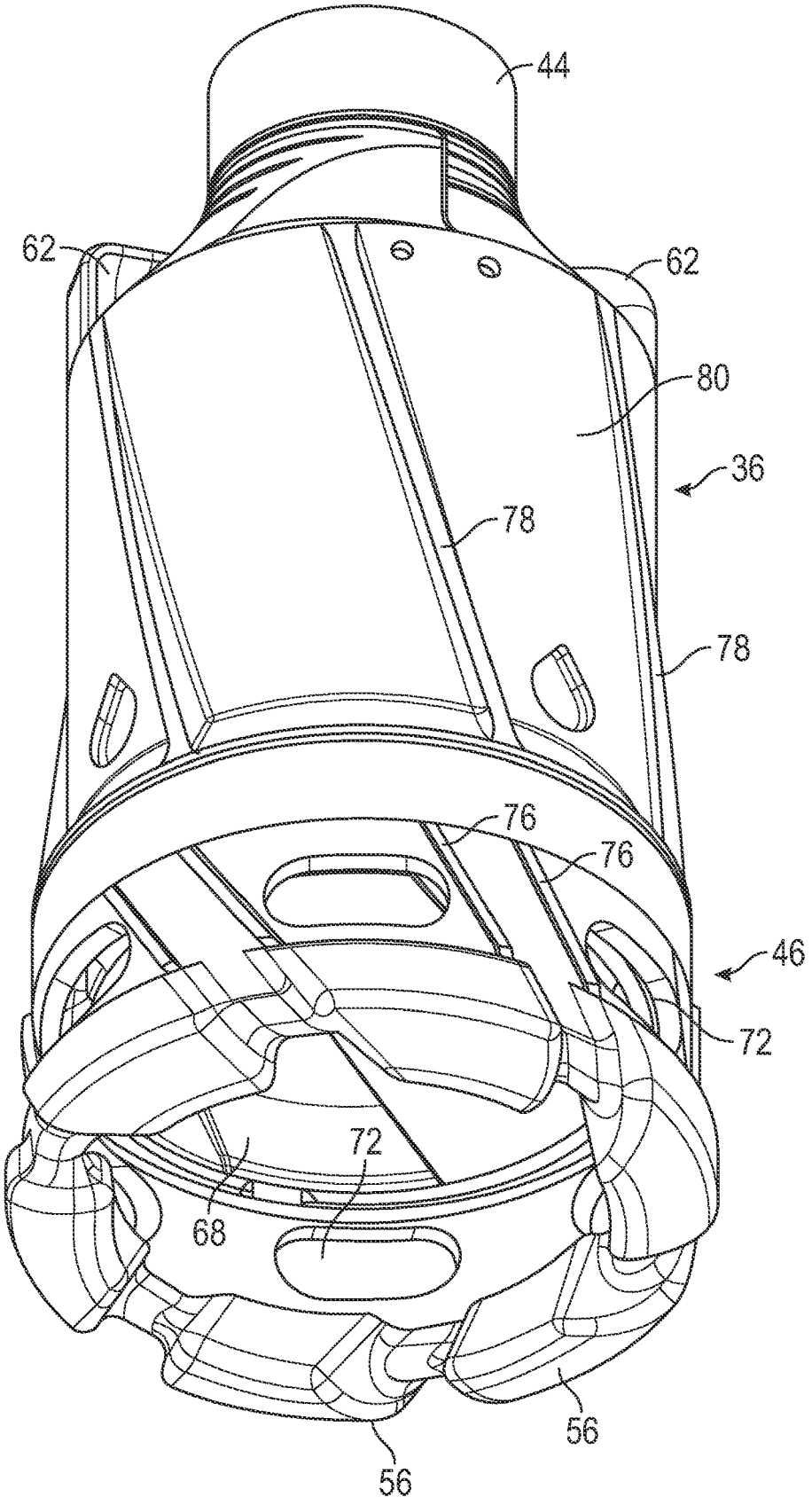
FIG. 12 is a perspective view of the coring shaft and coring bit of FIGS. 11A and 11B, according to one or more embodiments of the present disclosure.

FIG. 12 is a perspective view of the coring shaft 36 and the coring bit 46 of FIGS. 11A and 11B to further illustrate certain combination of features of the coring shaft 36 and the coring bit 46. In particular, FIG. 12 illustrates a coring shaft 36 and coring bit 46 that include, among other things, a plurality of scoops 62, a plurality of internal grooves 68, a plurality of fins 76, 78, a plurality of cutting pads 56, and a plurality of junk slots 72 that facilitate the creation of the defined or directed flow of mud illustrated in FIGS. 11A and 11B. As illustrated, in certain embodiments, the fins 76, 78 may be tapered (e.g., having a smaller outer diameter, or height, at a first axial end closer to the coring motor 34 of the sidewall coring tool assembly 12 than at a second axial end farther away from the coring motor 34) so that the fins 76, 78 do not restrict angular movement of coring shaft 36 during the "break cycle" used to break a core plug 50 from the formation 14 (see, e.g., FIG. 2C).

As described in greater detail herein, the embodiment illustrated in FIG. 12 may include various modifications. For example, in certain embodiments, any number of fins 76, 78 (e.g., zero or more) may be used on the external surface 80. In addition, in certain embodiments, the fins 76, 78 may be symmetrical or asymmetrical. In addition, in certain embodiments, the fins 76, 78 may vary in the fin helix angle, the fin width (e.g., the circumferential variations in the fins 76, 78), the fin height (e.g., the radial variations in the fins 76, 78), and so forth. In addition, in certain embodiments, the fins 76, 78 may traverse either a full axial length or a partial axial length of the coring bit 46 or the coring shaft 36, respectively.

In addition, in certain embodiments, any number of internal grooves 68 (e.g., zero or more) may be used on the internal surface 70 of the coring shaft 36. In addition, in certain embodiments, the internal grooves 68 may be symmetrical or asymmetrical. In addition, in certain embodiments, the internal grooves 68 may vary in the groove helix angle, the groove width (e.g., the circumferential variations in the internal grooves 68), and so forth. In addition, in certain embodiments, the internal grooves 68 may traverse either a full axial length or a partial axial length of the coring shaft 36.

In addition, in certain embodiments, any non-zero number of scoops 62 (e.g., one or more) may be used on the coring shaft 36. In addition, in certain embodiments, the scoops 62 may be symmetrical or asymmetrical. In addition, in certain embodiments, the scoop entry angle (e.g., at an entry window at the external surface 80 of the coring shaft 36) and/or the scoop exit angle (e.g., at an exit window at the internal surface 70 of the coring shaft 36), which may be defined as an angle relative to the direction of rotation (see arrow 82 of FIGS. 11A and 11B) of the coring shaft 36, may be different from each other. Similarly, in certain embodiments, the entry and exit geometries and/or dimensions of each scoop 62 (e.g., at the entry and exit windows of the scoop 62, respectively) may be different from each other. Furthermore, in certain embodiments, the geometries and/or dimensions of each scoop 62 may be different than the geometries and/or dimensions of the other scoops 62.

As described above, certain embodiments described herein relate to sidewall coring tool assemblies 12 that have a coring bit 46, a coring shaft 36, and a static sleeve that may be used to collect samples (e.g., rock samples, tar sand samples, etc.) from subterranean formations 14 adjacent a borehole (or wellbore) 16. In general, the static sleeve described herein creates a core catching arrangement that does not rotate with the coring bit 46 because it is mechanically attached to a stationary portion of the coring motor 34. In addition, the static sleeve protects the core by eliminating rotating rubbing action on core OD and by protecting the core from cutting debris.

Figure 13:
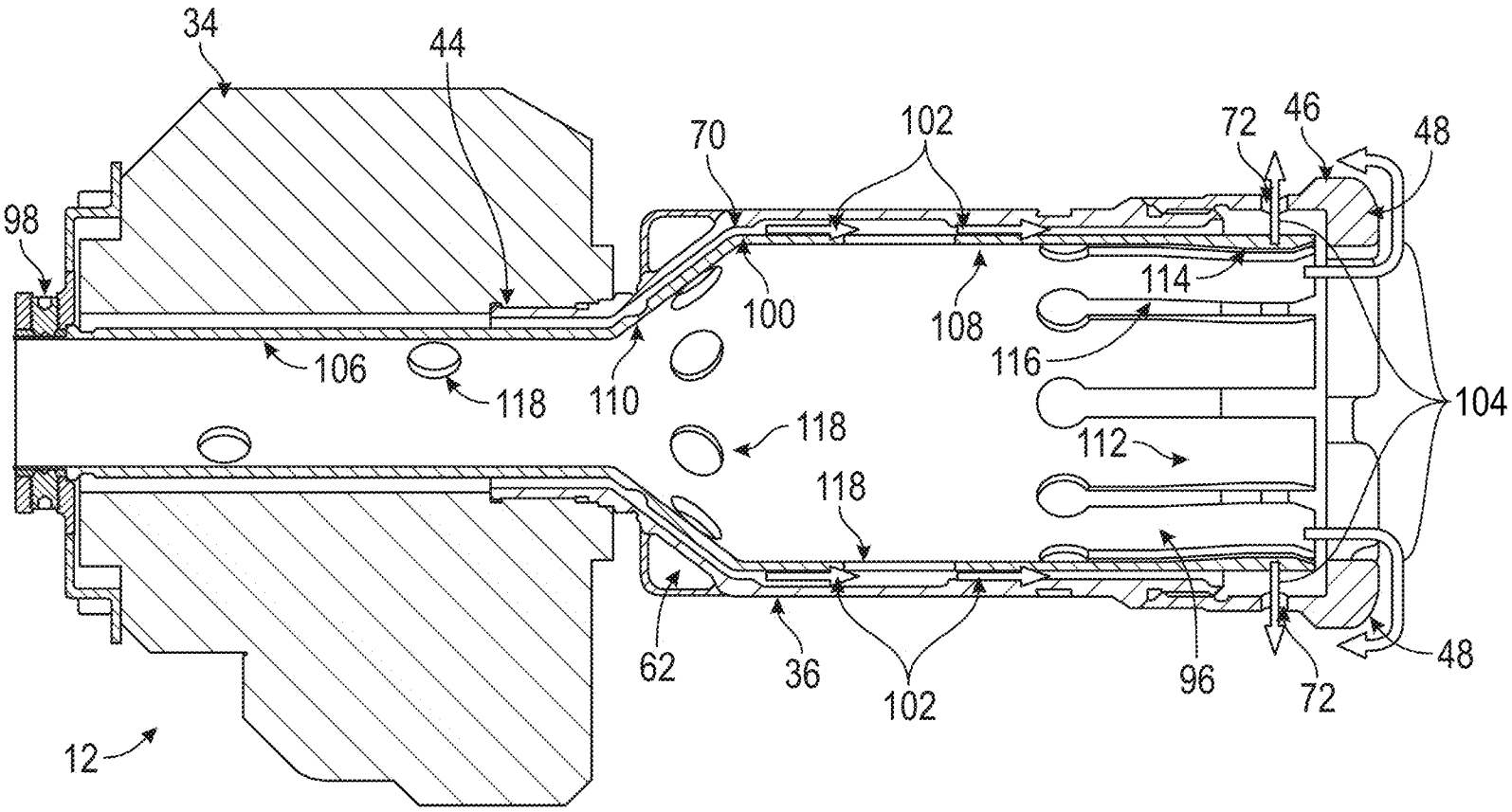
FIG. 13 is a cross-sectional side view of an embodiment of a sidewall coring tool assembly having a coring shaft and an associated static sleeve disposed radially within the coring shaft, according to one or more embodiments of the present disclosure.

FIG. 13 is a cross-sectional side view of an embodiment of a sidewall coring tool assembly 12 having a coring shaft 36 as described in greater detail herein and an associated static sleeve 96 disposed radially within the coring shaft 36. As illustrated, the coring shaft 36 is coupled to the coring motor 34 at one axial end and to the coring bit 46 at the opposite axial end. As described in greater detail herein, the coring shaft 36 and the coring bit 46 are configured to rotate relative to the coring motor 34 to enable creation of a core sample, as well as to facilitate the flow of drilling mud (and cutting debris disposed within the drilling mud) through the sidewall coring tool assembly 12.

In contrast, the static sleeve 96 is coupled to a stationary portion 98 of the coring motor 34 and is disposed radially within an internal surface 70 of the coring shaft 36, as described in greater detail herein. One advantage of the embodiment illustrated in FIG. 13 is that the static sleeve 96 protects the relatively fragile core sample from the flow of drilling mud created by the coring shaft 36, as described in greater detail herein. In addition, as described in greater detail herein, the drilling mud flow from the scoops 62 of the coring shaft 36 through an internal annulus 52 formed between an internal surface 70 of the coring shaft 36 and an external surface 100 of the static sleeve 96 to the coring bit 46 (e.g., as illustrated by arrows 102) for evacuation of cutting debris around the coring bit 46 and the bit face 48 (e.g., rock and bit interface) that contacts the formation 14, as illustrated by arrows 104. The static sleeve 96 is attached to a non-rotating portion 98 of the coring motor 34 and does not experience axial movement relative to the coring motor 34. In addition, the static sleeve 96 does not experience rotary motion relative to the core sample. Rather, there is only axial relative motion between the static sleeve 96 and the core sample.

As illustrated in FIG. 13, the static sleeve 96 has a relatively large diametrical section that corresponds to the similarly relative large diametrical section of the coring shaft 36 and the coring bit 46. For example, in certain embodiments, a ratio of the OD of the external surface 100 of the static sleeve 96 to the ID of the internal surface 70 of the coring shaft 36 may be in a range of approximately 90-99%, approximately 92-97%, or approximately 95% (within a 1% tolerance range), at least at the relatively constant diameter sections of the static sleeve 96 and the coring shaft 36, which extend axially a majority (e.g., over 35%, over 40%, over 45%, over 50%, or even more) of the total axial length of the coring shaft 36. As also illustrated in FIG. 13, in certain embodiments, the static sleeve 96 may extend axially away from the coring motor 34 slightly farther than the coring shaft 36 to, for example, enable direction of the drilling mud through the junk slots 72 of the coring bit 46 described herein.

In general, the static sleeve 96 grips, protects, and temporarily stores the sample rock core during core cutting operations. In the embodiment illustrated in FIG. 13, the static sleeve 96 has a relatively small diametrical section 106 that corresponds to the relatively small diametrical section of the coring motor shaft 44. The relatively long axial length of the relatively small diametrical section 106 (e.g., which may be over 45%, over 50%, over 55%, over 60%, or even more, of the total axial length of the static sleeve 96) may be referred to as a "stem" whose primary function is to indirectly couple the relatively large diametrical section 108 of the static sleeve 96 to a stationary mechanical attachment portion 98 of the coring motor 34 on an axial side of the coring motor 34 farthest away from the coring bit 46. The stem of the static sleeve 96 has features to mechanically attach to the non-rotating portion 98 of the coring motor 34. As illustrated, in certain embodiments, a tapered section 110 of the static sleeve 96 connects the relatively small diametrical section 106 to the relatively large diametrical section 108.

As also illustrated in FIG. 13, in certain embodiments, the static sleeve 96 has certain features at an axial end closer to the coring bit 46 that are configured to mechanically grip the rock core sample. For example, in certain embodiments, the relatively large diametrical section 108 of the static sleeve 96 has a plurality of fingers 112 with tapered entry points 114 that enable the static sleeve 96 to grip the rock core sample. In general, the slots 116 formed between adjacent fingers 112 allow drilling mud flow to prevent differential sticking of the static sleeve 96 and the rock core sample, closer to the coring bit 46. As also illustrated in FIG. 13, in certain embodiments, the static sleeve 96 may have a plurality of holes 118 extending through the static sleeve 96 and spaced along the axial length of the static sleeve 96, which allow for cutting debris evacuation and drilling mud flow, as well as also allowing for some drilling mud flow to further prevent differential sticking of the static sleeve 96 and the rock core sample at various axial locations along the static sleeve 96.

In addition, in certain embodiments, the external surface 100 of the static sleeve 96 may include certain features to facilitate the movement of the drilling mud along the axial lengths of the coring shaft 36 and the static sleeve 96 within the internal annulus 52 formed between the internal surface 70 of the coring shaft 36 and the external surface 100 of the static sleeve 96. As but one non-limiting example, in certain embodiments, the external surface 100 of the static sleeve 96 may include external grooves (not shown) that are configured similarly to the internal grooves 68 of the coring shaft 36, as described in greater detail herein. For example, the external grooves of the static sleeve 96 may have similar groove helix angles that correspond to groove helix angles of the internal grooves 68 of the coring shaft 36. However, in other embodiments, the static sleeve 96 may be relatively smooth, with no additional features.

Figure 14:
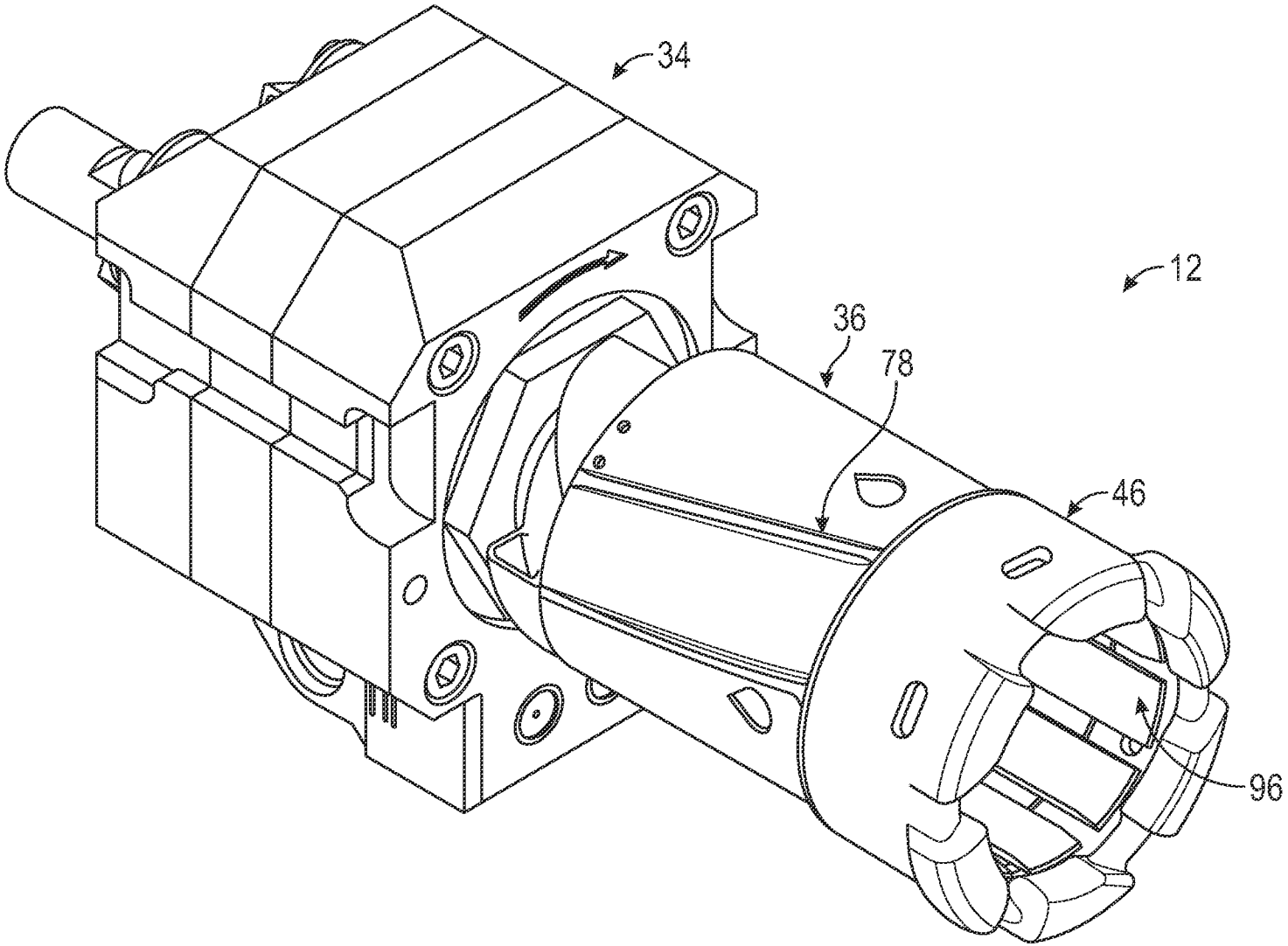
FIG. 14 is perspective view of an embodiment of a sidewall coring tool assembly having a coring shaft with fins and an associated static sleeve, according to one or more embodiments of the present disclosure.
Figure 15:
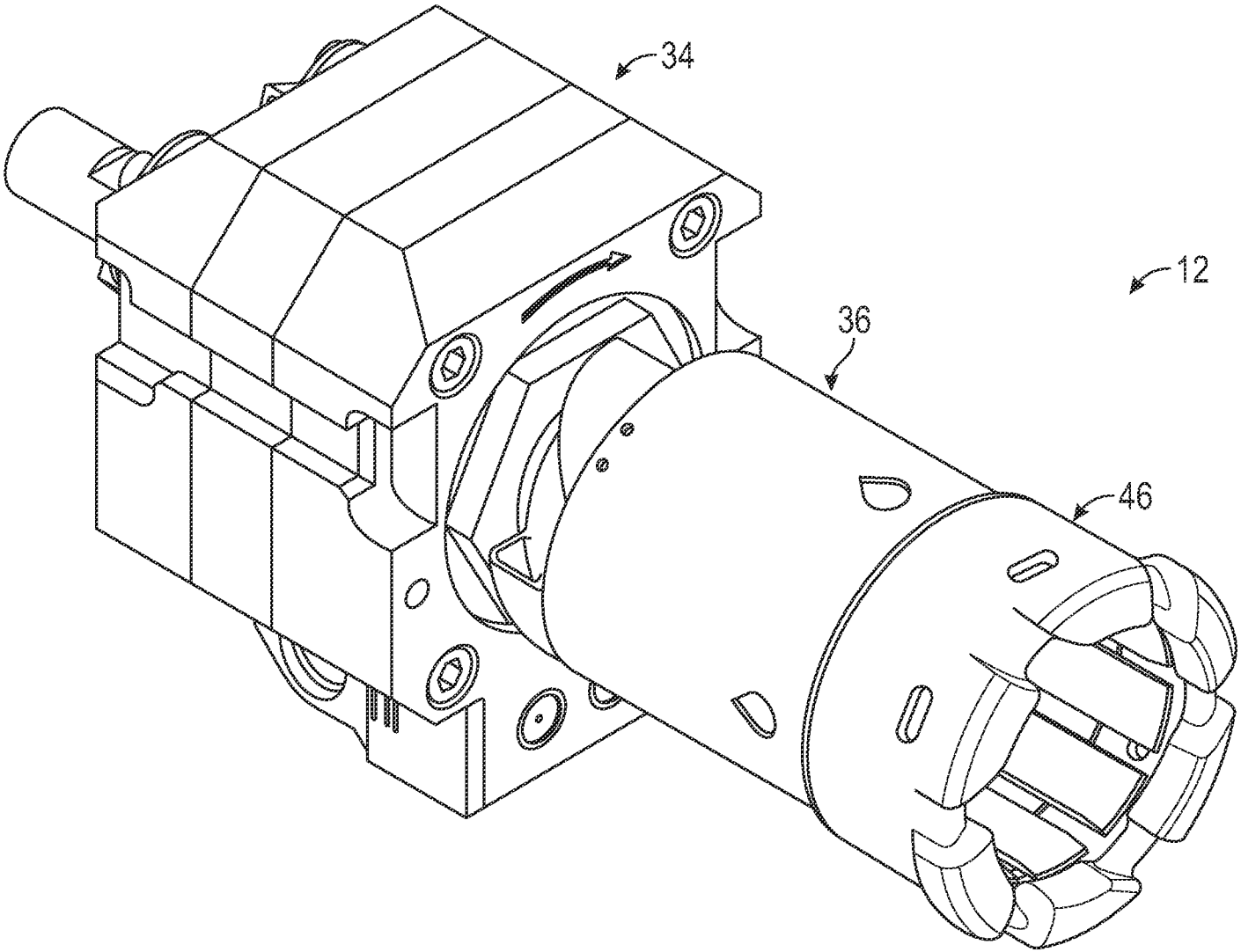
FIG. 15 is perspective view of an embodiment of a sidewall coring tool assembly having a coring shaft without fins, but having an associated static sleeve, according to one or more embodiments of the present disclosure.

To compare and contrast certain embodiments described herein, FIG. 14 is perspective view of an embodiment of a sidewall coring tool assembly 12 having a coring shaft 36 with fins 78 as described in detail herein and an associated static sleeve 96, whereas FIG. 15 is perspective view of an embodiment of a sidewall coring tool assembly 12 having a coring shaft 36 without fins 78, but having an associated static sleeve 96. Indeed, it will be appreciated that any and all of the features described as being various features of alternate embodiments of the sidewall coring tool assemblies 12 may be used in any combination, and that some of the features may be omitted from certain embodiments.

The embodiments described herein include a sidewall coring tool assembly 12 that includes a coring shaft 36 having an internal cavity and configured to be coupled to a coring motor shaft 44 of a coring motor 34 at a first axial end of the coring shaft 36. In certain embodiments, the coring shaft 36 may include a plurality of scoops 62 disposed circumferentially on a first external surface of the coring shaft 36. Each scoop 62 of the plurality of scoops 62 forms a conduit from an exterior of the coring shaft 36 to an interior of the coring shaft 36. In certain embodiments, the sidewall coring tool assembly 12 also includes a coring bit 46 coupled to the coring shaft 36 at a second axial end of the coring shaft 36. In certain embodiments, the sidewall coring tool assembly 12 may further include a static sleeve 96 coupled to the coring motor 34 and disposed radially within the internal cavity of the coring shaft 36.

In addition, in certain embodiments, the static sleeve 96 may be coupled to a stationary portion 98 of the coring motor 34, and the coring shaft 36 may be coupled to a rotatable portion of the coring motor 34. In addition, in certain embodiments, the stationary portion 98 of the coring motor 34 may be located on an axial side of the coring motor 34 farthest away from the coring bit 46. In addition, in certain embodiments, a ratio of an outer diameter of the static sleeve 96 and an inner diameter of the coring shaft 36 at the second axial end of the coring shaft 36 may be greater than 90%. In addition, in certain embodiments, the outer diameter of the static sleeve 96 may extend axially along at least 35% of the static sleeve 96.

In addition, in certain embodiments, the static sleeve 96 may include a plurality of fingers 112 at an axial end of the static sleeve 96 closest to the coring bit 46. In addition, in certain embodiments, each finger 112 of the plurality of fingers 112 may include a tapered entry point 114 configured to grip a rock core sample. In addition, in certain embodiments, the static sleeve 96 may include a plurality of holes 118 extending through the static sleeve 96 and spaced along an axial length of the static sleeve 96.

In addition, in certain embodiments, the coring shaft 36 may include a plurality of internal grooves 68 disposed on an internal surface 70 of the coring shaft 36. In addition, in certain embodiments, the static sleeve 96 may include a plurality of external grooves disposed on an external surface 100 of the static sleeve 96. The plurality of external grooves generally correspond to the plurality of internal grooves 68 of the coring shaft 36. In addition, in certain embodiments, the coring shaft may include a plurality of fins 76, 78 disposed on at least one of a second external surface of the coring bit 46 and the first external surface of the coring shaft 36.

While the present disclosure may be susceptible to various modifications and alternative forms, specific embodiments have been shown by way of example in the drawings and have been described in detail herein. However, it should be understood that the present disclosure is not intended to be limited to the particular forms disclosed. For example, while some embodiments described herein contain specific combinations of coring systems, other combinations may also be possible. Rather, the present disclosure is intended to cover all modifications, equivalents, and alternatives falling within the spirit and scope of the present disclosure as defined by the following appended claims. In particular, it will be appreciated that any and all combinations and sub-combinations of the various features described herein may be included or omitted from any particular embodiment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112 (f). However, for any claims containing elements designated in any other manner, it is intended that such elements are not to be interpreted under 35 U.S.C. § 112(f).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sidewall coring tool assembly, comprising:

a coring shaft having an internal cavity and configured to be coupled to a coring motor shaft of a coring motor at a first axial end of the coring shaft, wherein the coring shaft comprises a plurality of internal grooves disposed on an internal surface of the coring shaft, wherein the coring shaft comprises a plurality of scoops disposed circumferentially on a first external surface of the coring shaft, and wherein each scoop of the plurality of scoops forms a conduit from an exterior of the coring shaft to an interior of the coring shaft;

a coring bit coupled to the coring shaft at a second axial end of the coring shaft; and a static sleeve coupled to the coring motor and disposed radially within the internal cavity of the coring shaft, wherein the static sleeve comprises a plurality of external grooves disposed on an external surface of the static sleeve, and wherein the plurality of external grooves corresponds to the plurality of internal grooves of the coring shaft.

2. The sidewall coring tool assembly of claim 1, wherein the static sleeve is coupled to a stationary portion of the coring motor, and wherein the coring shaft is coupled to a rotatable portion of the coring motor.

3. The sidewall coring tool assembly of claim 2, wherein the stationary portion of the coring motor is located on an axial side of the coring motor farthest away from the coring bit.

4. The sidewall coring tool assembly of claim 1, wherein a ratio of an outer diameter of the static sleeve and an inner diameter of the coring shaft at the second axial end of the coring shaft is greater than 90%.

5. The sidewall coring tool assembly of claim 1, wherein the static sleeve comprises a plurality of fingers at an axial end of the static sleeve closest to the coring bit.

6. The sidewall coring tool assembly of claim 5, wherein each finger of the plurality of fingers comprise a tapered entry point configured to grip a rock core sample.

7. The sidewall coring tool assembly of claim 1, wherein the static sleeve comprises a plurality of holes extending through the static sleeve and spaced along an axial length of the static sleeve.

8. The sidewall coring tool assembly of claim 1, wherein the coring bit comprises at least two cutting pads configured to create at least two outer passage areas circumferentially between the at least two cutting pads and radially exterior to the coring bit and at least two inner passage areas circumferentially between the at least two cutting pads and radially interior to the coring bit.

9. A sidewall coring tool assembly, comprising:

a coring shaft having an internal cavity and configured to be coupled to a coring motor shaft of a coring motor at a first axial end of the coring shaft, wherein the coring shaft comprises a plurality of internal grooves disposed on an internal surface of the coring shaft, wherein the coring shaft comprises a plurality of scoops disposed circumferentially on a first external surface of the coring shaft, and wherein each scoop of the plurality of scoops forms a conduit from an exterior of the coring shaft to an interior of the coring shaft;

a coring bit coupled to the coring shaft at a second axial end of the coring shaft;

a plurality of fins disposed on at least one of a second external surface of the coring bit and the first external surface of the coring shaft; and a static sleeve coupled to the coring motor and disposed radially within the internal cavity of the coring shaft, wherein the static sleeve comprises a plurality of external grooves disposed on an external surface of the static sleeve, and wherein the plurality of external grooves corresponds to the plurality of internal grooves of the coring shaft.

10. The sidewall coring tool assembly of claim 9, wherein the static sleeve is coupled to a stationary portion of the coring motor located on an axial side of the coring motor farthest away from the coring bit, and wherein the coring shaft is coupled to a rotatable portion of the coring motor.

11. The sidewall coring tool assembly of claim 9, wherein a ratio of an outer diameter of the static sleeve and an inner diameter of the coring shaft at the second axial end of the coring shaft is greater than 90%.

12. The sidewall coring tool assembly of claim 9, wherein the static sleeve comprises a plurality of fingers at an axial end of the static sleeve closest to the coring bit, and wherein each finger of the plurality of fingers comprises a tapered entry point configured to grip a rock core sample.

13. The sidewall coring tool assembly of claim 9, wherein the static sleeve comprises a plurality of holes extending through the static sleeve and spaced along an axial length of the static sleeve.

14. The sidewall coring tool assembly of claim 9, wherein the coring bit comprises at least two cutting pads configured to create at least two outer passage areas circumferentially between the at least two cutting pads and radially exterior to the coring bit and at least two inner passage areas circumferentially between the at least two cutting pads and radially interior to the coring bit.

* * * * *